US007106295B2

(12) United States Patent
Watanabe et al.

(10) Patent No.: US 7,106,295 B2
(45) Date of Patent: Sep. 12, 2006

(54) LIQUID CRYSTAL DISPLAY DEVICE

(75) Inventors: Hiroshi Watanabe, Mobara (JP); Shinji Yasukawa, Shirako (JP); Hidetoshi Kida, Mobara (JP); Yoshihisa Ooishi, Yokohama (JP)

(73) Assignees: Hitachi, Ltd., Tokyo (JP); Hitachi Device Engineering Co. Ltd., Chiba-ken (JP)

( * ) Notice: Subject to any disclaimer, the term of this patent is extended or adjusted under 35 U.S.C. 154(b) by 161 days.

(21) Appl. No.: 10/359,706

(22) Filed: Feb. 7, 2003

(65) Prior Publication Data

US 2003/0174107 A1 Sep. 18, 2003

(30) Foreign Application Priority Data

Mar. 18, 2002 (JP) ..... 2002-073495

(51) Int. Cl.
*G09G 3/36* (2006.01)

(52) U.S. Cl. ..... 345/103; 345/98; 345/92; 345/97; 345/100

(58) Field of Classification Search ..... 345/87–103, 345/211, 150, 204–206, 147; 349/149–152; 257/59, 60; 438/158, 149, 22
See application file for complete search history.

(56) References Cited

U.S. PATENT DOCUMENTS 5,841,414 A * 11/1998 Tanaka ..... 345/87
5,897,188 A * 4/1999 Sasuga et al. ..... 349/150
6,115,017 A * 9/2000 Mikami et al. ..... 345/92
6,160,605 A * 12/2000 Murayama et al. ..... 349/152
6,356,252 B1 * 3/2002 Park ..... 345/87
6,411,359 B1 * 6/2002 Kobayashi et al. ..... 349/149
6,452,590 B1 * 9/2002 Awamoto et al. ..... 345/211
6,507,384 B1 * 1/2003 Endo et al. ..... 349/149
6,532,055 B1 * 3/2003 Oishi ..... 349/149
6,636,288 B1 10/2003 Kim et al.
6,639,589 B1 10/2003 Kim et al.
6,825,071 B1 * 11/2004 Suzawa et al. ..... 438/158
6,900,462 B1 * 5/2005 Suzawa et al. ..... 257/59
6,924,867 B1 * 8/2005 Hinata ..... 349/149
2001/0043176 A1 * 11/2001 Park ..... 345/87
2002/0005517 A1 * 1/2002 Inoue ..... 257/66
2002/0105005 A1 * 8/2002 Seo et al. ..... 257/101
2003/0063081 A1 * 4/2003 Kimura et al. ..... 345/211
2004/0070721 A1 * 4/2004 Tsubokura et al. ..... 349/149
2004/0183984 A1 * 9/2004 Imajo et al. ..... 349/151
2005/0078073 A1 * 4/2005 Mikami et al. ..... 345/92
2005/0116882 A1 * 6/2005 Yamazaki et al. ..... 345/8

* cited by examiner

*Primary Examiner*—Bipin Shalwala
*Assistant Examiner*—Prabodh Dharia
(74) *Attorney, Agent, or Firm*—Reed Smith LLP; Stanley P. Fisher, Esq.; Juan Carlos A. Marquez, Esq.

(57) ABSTRACT

The present invention realizes proper driving circuits in a driving-circuit integral type liquid crystal display device which has an increased screen size. The liquid crystal display device includes a liquid crystal display panel and a driving circuit which supplies video signals to video signal lines formed on the liquid crystal display panel. The driving circuit is comprised of a first driving circuit which is formed in a step similar to a step for forming pixels provided to the liquid crystal display panel and a second driving circuit which is connected to the liquid crystal display panel after formation of the liquid crystal display panel. The first driving circuit is constituted of a switching circuit which is capable of distributing an output of the second driving circuit to a plurality of video signal lines.

3 Claims, 19 Drawing Sheets

LIQUID CRYSTAL DISPLAY DEVICE

BACKGROUND OF THE INVENTION

1. Field of the Invention

The present invention relates to a liquid crystal display device, and more particularly to an active-matrix type liquid crystal display device of a thin film transistor (TFT) type or the like which uses polysilicon.

2. Description of the Related Art

Among liquid crystal display devices, liquid crystal display devices of a thin film transistor (TFT) type have been popularly used as display devices for personal computers or the like. The liquid crystal display device includes a liquid crystal display panel and driving circuits which drive the liquid crystal display panel. The liquid crystal display panel is configured such that two substrates are arranged to face each other in an opposed manner, a gap is defined between these two substrates, and a liquid crystal composition is filled in the gap. The substrates which form the liquid crystal display panel include pixel electrodes and counter electrodes. When a voltage is applied between the pixel electrodes and the counter electrodes, the orientation direction of liquid crystal molecules present between the pixel electrodes and the counter electrodes is changed so that the optical transmissivity of the liquid crystal display panel is changed. The display is performed by making use of this change of optical transmissivity. The liquid crystal display devices of a thin film transistor (TFT) type includes a switching element for each pixel electrode and the voltage is supplied to the pixel electrode through the switching element.

With respect to the liquid crystal display device of a thin film transistor (TFT) type, there has been known a vertical field type liquid crystal display device in which the pixel electrodes are formed on one substrate and the counter electrodes are formed on another substrate, and a lateral field type (in-plane type) liquid crystal display device in which the pixel electrodes and the counter electrodes are formed on one substrate.

A voltage supplied to the pixel electrodes is supplied to the vicinity of the pixel electrodes through video signal lines and is connected to the switching elements. Further, signals which turn on or off the switching elements are supplied through scanning signal lines. In the liquid crystal display device of a thin film transistor (TFT) type, a plurality of video signal lines extend in the vertical direction and are arranged in parallel in the lateral direction. Further, a plurality of scanning signal lines are extend in the lateral direction by intersecting the video signal lines and are arranged in parallel in the vertical direction. The pixel electrode is formed in a region which is enclosed by two neighboring video signal lines and two scanning signal lines which cross the video signal lines. The pixel electrodes are arranged in a matrix array so as to form a display region. In the periphery of the display region, driving circuits which supply signals to the video signal lines and the scanning signal lines are formed.

As the switching element, a TFT which uses an amorphous silicon and a TFT which uses polysilicon (hereinafter referred to as "polysilicon TFT") are known. With respect to the liquid crystal display device using the polysilicon TFTs, a liquid crystal display device which forms the driving circuits on the same substrate on which the pixel electrodes are formed (hereinafter referred to as "driving circuit integral type liquid crystal display device") is known.

An image is inputted from the outside (for example, a personal computer) to the liquid crystal display device as video signals. The video signals contain data on the voltages (gray scale voltages) applied to respective pixel electrodes. In general, the video signals are either analogue signals or digital signals. In the driving circuit integral type liquid crystal display device using the polysilicon TFTs, the driving circuits of an analogue signal inputting type have been used conventionally. The driving circuit of an analogue signal inputting type receives the video signals in the form of analogue signals from the outside, sample-holds the analogue signals and, thereafter, outputs the video signals to the video signal lines.

SUMMARY OF THE INVENTION

In the driving circuit integral type liquid crystal display device, corresponding to the increase of a screen size, a scale of the driving circuits is increased. Further, also in the driving circuit integral type liquid crystal display device using polysilicon TFTs, there is a demand for driving circuits of a digital-analogue conversion type which receive signals inputted to the liquid crystal display device in the form of digital signals and converts the digital signals into voltages applied to the pixel electrodes in the driving circuits.

Further, for the purpose of simplifying manufacturing steps and for lowering a defect occurrence rate, there has been proposed an idea to manufacture the driving circuit integral type liquid crystal display device using either one of n-type semiconductors or p-type semiconductors. In forming the driving circuits of a digital-analogue conversion type using the polysilicon TFTs, when the number of pixels is increased corresponding to the increase of the screen size, there arises a drawback that the performance of the driving circuits cannot follow a driving speed. There also arises a problem that a scale of the circuits is increased and a pull-around length of wiring for signals and power supply is prolonged and hence, it is difficult to ignore the influence of distortion of signal waveforms and noises. Further, when the driving circuits are formed using only one conductive type, the above-mentioned drawbacks become more apparent.

The present invention has been made to overcome the above-mentioned drawbacks of the prior art and provides a technique which can realize appropriate driving circuits in a polysilicon TFT type liquid crystal display device.

The above-mentioned and other objects and novel features of the present invention are made apparent in accordance with the description of this specification and attached drawings.

To briefly explain the summary of typical inventions among the inventions described in the present application, they are as follows.

That is, the present invention is directed to a liquid crystal display device in which the display device includes a liquid crystal display panel and driving circuits which supply video signals to the liquid crystal display panel, the driving circuits are comprised of a first driving circuit which is formed in a step similar to a step for forming pixels provided to the liquid crystal display panel and a second driving circuit which is connected to the liquid crystal display panel after formation of the liquid crystal display panel, and the second driving circuit is capable of supplying signals from one output thereof to n pieces of video signal lines of the liquid crystal display panel.

Further, the present invention is also directed to a liquid crystal display device in which the display device includes a liquid crystal display panel and driving circuits which supply gray scale voltages to the liquid crystal display panel, and the driving circuit is comprised of a first driving circuit which is formed of transistors of a conductive type similar to a conductive type of pixels provided to the liquid crystal display panel and a second driving circuit which is mounted on the liquid crystal display panel.

Still further, the present invention is also directed to a liquid crystal display device in which the display device includes a liquid crystal display panel and a first driving circuit and a second driving circuit which supply video signals to the liquid crystal display panel, the second driving circuit is mounted on a flexible board, and signals are supplied to the first driving circuit through wiring provided to the flexible board.

DETAILED DESCRIPTION OF THE PREFERRED EMBODIMENTS

Embodiments of the present invention are explained in detail hereinafter in conjunction with attached drawings.

Here, in all drawings served for explaining the embodiments, parts which have identical functions are indicated by same numerals and their repeated explanation is omitted.

Figure 1:
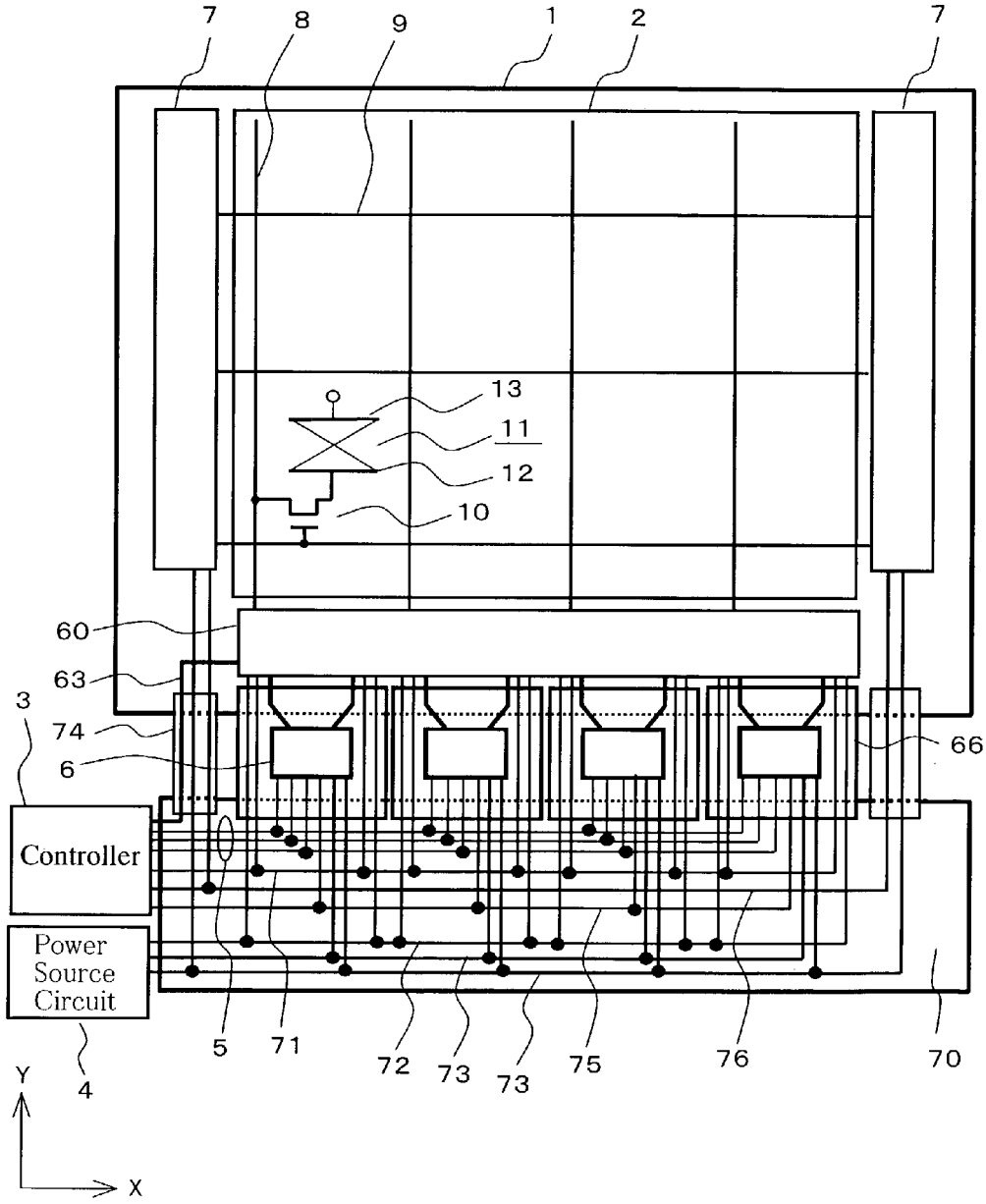
FIG. 1 is a block diagram showing the schematic constitution of a liquid crystal display device according to one embodiment of the present invention.

FIG. 1 is a block diagram showing the schematic constitution of a liquid crystal display device according to one embodiment of the present invention.

In the drawing, numeral 1 indicates a liquid crystal display panel and numeral 2 indicates a display part. An image is displayed on the display part 2 in accordance with display data. Numeral 3 indicates a controller. Display data, control signals and the like are inputted to the controller 3 from the outside (computer or the like). The controller 3 receives the display data, the control signals and the like from the outside and supplies the display data, various clock signals and various control signals to the liquid crystal display panel 1. Numeral 4 indicates a power supply circuit 4 which is provided for generating various driving voltages for driving the liquid crystal display panel 1. Although the liquid crystal display panel 1 is driven by driving circuits, in this embodiment, a first source driver 60 is formed in the liquid crystal display panel 1 and, further, second source drivers 6 are connected to the liquid crystal display panel 1.

Data bus lines 5 are connected to the second source driver 6. The display data are outputted to the data bus lines 5 from the controller 3. Further, the controller 3 converts the control signals inputted from the outside and outputs signals which control the liquid crystal display panel 1. As the control signals which the controller 3 outputs, timing signals such as clock signals which are served for allowing the second source drivers 6 to fetch the display data, time-division control signals which are served for changing over outputs from the first source driver 60 to the liquid crystal display panel 1, and gate clock signals which are served for outputting frame start command signals and sequential scanning signals for driving a gate driver 7 are named.

Further, the power supply circuit 4 generates and outputs a positive-pole gray scale voltage, a negative-pole gray scale voltage, a counter electrode voltage, a scanning signal voltage and the like. Here, with respect to power supply lines which supply power supply voltages to respective circuits are omitted for obviating the cumbersomeness of the drawing brought about by drawing these lines. It should be taken for granted that the power supply voltages are supplied to respective circuits.

The display data outputted from the controller 3 are transferred to the second source drivers 6 through the data bus lines 5. The display data are digital data and the number of data bus lines 5 is determined based on a quantity of data to be transferred. For example, in case of data of 6 bits, the number of data bus lines 5 is set to 6. Here, to perform a color display, the liquid crystal display panel 1 has pixels of red (R), green (G) and blue (B) and respective display data of red (R), green (G) and blue (B) are transferred as a set. Accordingly, to transfer respective display data of red (R), green (G) and blue (B) as a set, 18 data bus lines in total are used.

Here, when the display data of red (R), green (G) and blue (B) are transferred for every two pixels as a set, 36 data bus lines in total are used. Further, with respect to data of 8 bits, 48 data bus lines in total are used. To facilitate the understanding of the drawing, the data bus lines 5 are indicated by three lines in FIG. 1.

The controller 3 outputs display data to the data bus lines 5 every unit time. Further, the display data are outputted to the data bus lines 5 in a sequential order. The second source drivers 6 fetch data to be displayed out of the display data which are sequentially outputted. Timing that the second source drivers 6 fetch the display data follows the clock signals.

The second source drivers 6 are arranged in the lateral direction (x direction) along the periphery of the display part 2. Outputs terminals of the second source drivers 6 are connected to the first source driver 60 formed on the liquid crystal display panel 1. The first source driver 60 is formed on the liquid crystal display panel 1 and output terminals of the first source driver 60 are connected to video signal lines 8 of the liquid crystal display panel 1. The video signal lines 8 extend in the direction Y in the drawing and are connected to drain electrodes of thin film transistors 10. Further, the video signal lines 8 are arranged in parallel in the direction X in the drawing.

The output terminals of the first source driver 60 is configured such that the terminals are connectable with a plurality of video signal lines 8. The second source drivers 6 output the gray scale voltages to the first source driver 60 in accordance with the display data. In accordance with a distributing control signal transmitted from the controller 3 through a distribution control signal line 63, the first source driver 60 changes over the connection between the output of the first source driver 60 and a plurality of video signal lines 8 so as to output the gray scale voltage to respective video signal lines 8 for predetermined periods. Here, the distributing control signal line 63 has one end thereof connected to a printed wiring board 70 and the other end thereof connected to the liquid crystal display panel 1 through a flexible board 74. Further, the second source drivers 6 are mounted on the flexible boards 66 and are connected between the printed wiring board 70 and the liquid crystal display panel 1.

The second source drivers 6 and the first source driver 60 are described in detail later. Further, although the manner of naming "source" and "drain" may be reversed based on the bias relationship, in this embodiment, a region of the thin film transistor 10 which is connected to the video signal line 8 is named as "source" (source region).

Along a side of the display part 2 in the vertical direction (direction Y) in the drawing, the gate driver (scanning circuit) 7 is formed. Output terminals of the gate driver 7 are connected to the scanning signal lines 9 of the liquid crystal display panel 1. The scanning signal lines 9 extend in the direction X in the drawing and are connected to gate electrodes of the thin film transistors 10. Further, a plurality of scanning signal lines 9 are arranged in parallel in the direction Y. The gate driver 7 sequentially supplies scanning voltages to the scanning signal lines 9 every one horizontal scanning period in response to a frame start command signal and shift clocks transmitted from the controller 3. The thin film transistor 10 is subjected to an ON/OFF control due to the scanning voltages applied to the gate electrodes.

The display part 2 of the liquid crystal display panel 1 has pixel portions 11 which are arranged in a matrix array. However, to simplify the drawing, only one pixel portion 11 is shown in FIG. 1. Each pixel portion 11 includes the thin film transistor 10 and a pixel electrode 12. Each pixel portion 11 is arranged in a crossing portion where two neighboring video signal lines 8 and two neighboring scanning signal lines 9 cross each other (region surrounded by four signal lines).

As mentioned previously, the scanning signals are outputted to the scanning signal lines 9 from the gate driver 7. The thin film transistors 10 are turned on or off in response to the scanning signals. Gray scale voltages are supplied to the video signal lines 8, wherein when the thin film transistors 10 are turned on, the gray scale voltages are supplied to the pixel electrodes 12 through the video signal lines 8. Counter electrodes (common electrodes) 13 are arranged to face the pixel electrodes 12, while a liquid crystal layer (not shown in the drawing) is formed between the pixel electrodes 12 and the counter electrodes 13. Here, in FIG. 1, a liquid crystal capacity is equivalently connected between the pixel electrode 12 and the counter electrode 13 on the drawing.

By applying a voltage between the pixel electrodes 12 and the counter electrodes 13, the orientation direction of liquid crystal molecules in a liquid crystal layer is changed. Display is performed by making use of a fact that the optical transmissivity is changed in response to the change of the orientation of the liquid crystal molecules in the liquid crystal display panel. An image displayed by the liquid crystal display panel 1 is constituted of pixels. The gray scale (optical transmissivity) of each pixel which constitutes the image follows a voltage supplied to the pixel electrode 12. The second source drivers 6 receive the gray scales to be displayed as display data and convert the gray scales into corresponding gray scale voltages and output the gray scale voltages. Accordingly, along with the increase of the number of pixels which the liquid crystal display panel 1 displays, the number of outputs of the second source drivers 6 is increased. Further, along with the increase of the number of gray scales which the liquid crystal display panel 1 displays, a data quantity of display data and the number of data bus lines 5 are also increased.

Subsequently, an AC driving is explained. It is known that when a direct current voltage is applied to the liquid crystal for a long period, the liquid crystal is deteriorated. To prevent the deterioration of the liquid crystal, the AC driving which periodically reverses the polarity of a voltage applied to a liquid crystal layer is performed. In the AC driving, with respect to the counter electrode 13, the signal voltages of positive polarity and negative polarity are applied to the pixel electrode 12. Accordingly, the power supply circuit 4 includes a positive pole gray scale voltage generating circuit and a negative pole gray scale voltage generating circuit. The second source driver 6 selects the gray scale voltage of either positive polarity or negative polarity even when the display data is the same in response to the AC signals.

Figure 2:
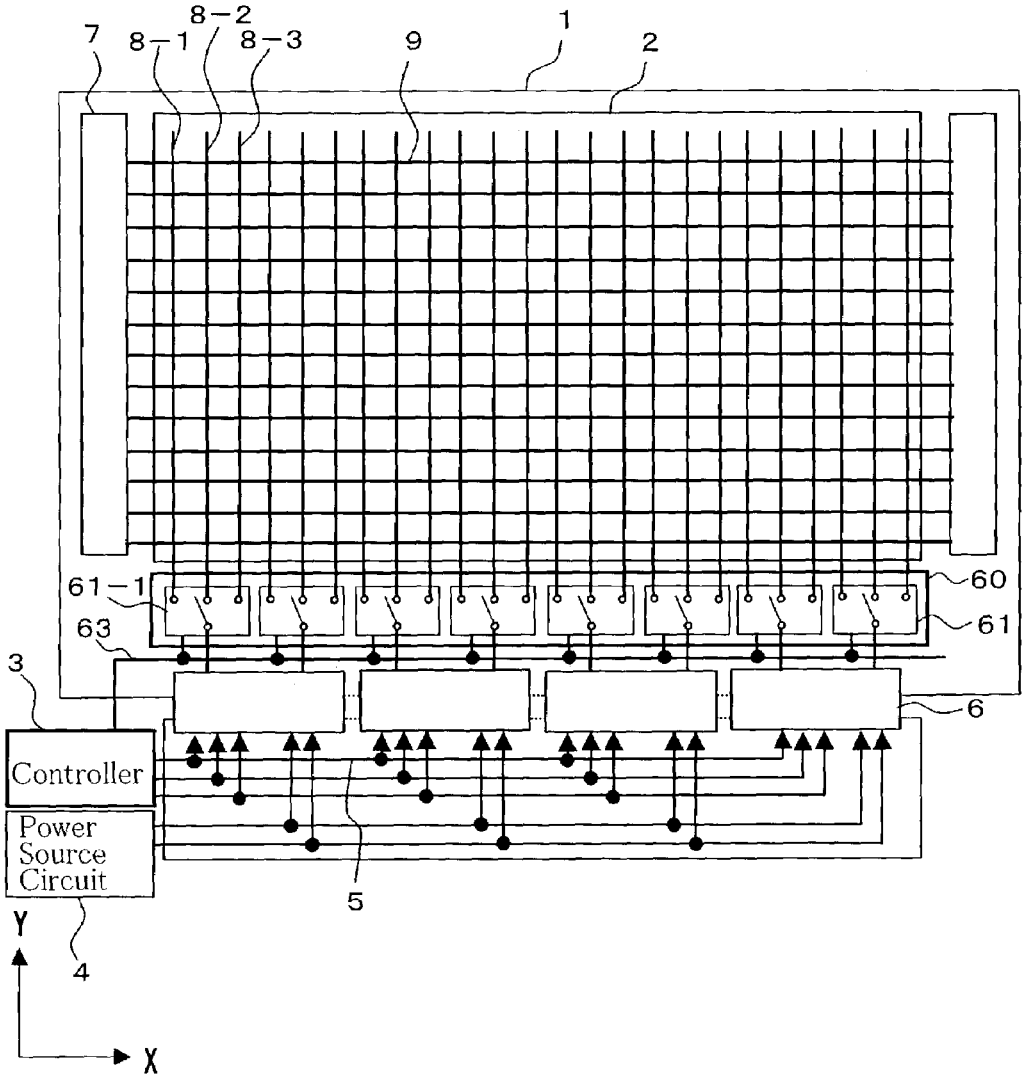
FIG. 2 is a schematic block diagram showing the schematic constitution of the liquid crystal display device according to one embodiment of the present invention.

Then, the first source driver 60 is explained in conjunction with FIG. 2. In FIG. 2, the first source driver 60 includes distributing circuits 61. The distributing circuit 61 is capable of changing over the connection between an input and a plurality of video signal lines 8. The distributing control signal line 63 is connected to the distributing circuits 61 and distributing control signals are transmitted to the distributing circuits 61 through the distributing control signal line 63. The distributing circuits 61 are controlled in response to the distributing control signals. To explain the control of the distributing circuits 61 using the distributing circuit 61-1 arranged at a left end in the drawing, the distributing circuit 61-1 is capable of outputting an output of the second source driver 6 to the video signal lines 8-1 to 8-3 by changing over the connection thereof. However, there is no case that all of the video signal lines 8-1 to 8-3 are simultaneously connected to the output of the second source driver 6. That is, the connection of the second source driver 6 to respective video signal lines is subjected to time division such that the output of the second source driver 6 is connected to the video signal line 8-1 for a fixed period and, thereafter, the output of the second source driver 6 is connected to the video signal line 8-2, for example.

As mentioned previously, it is possible to supply one output from the second source driver 6 to a plurality of video signal lines 8 with the use of the first source driver 60. Accordingly, when the number of pixels of the liquid crystal display panel 1 is increased, it is possible to prevent the increase of the scale of the circuit. For example, when the first source driver 60 is capable of supplying the gray scale voltage to two video signal lines 8, output circuits of the second source drivers 6 can be halved. Further, with respect to the connection between the second source drivers 6 and the liquid crystal display panel 1, the number of connection portions can be halved. Further, when the first source driver 60 is capable of supplying the gray scale voltage to three video signal lines 8, the output circuits of the second source drivers 6 can be reduced to one third. Further, with respect to the connection between the second source drivers 6 and the liquid crystal display panel 1, the number of connection portions can be reduced to one third. Since the number of connection failure occurrence portions is reduced and a pitch between connection terminals is increased corresponding to the reduction of the number of connection portions, it is possible to enhance the reliability of connection.

However, when the same gray scale voltage is applied to three video signal lines 8, the apparent number of pixels is decreased. To solve this problem, the second source driver 6 is required to output the respective gray scale voltages to be supplied to a plurality of video signal lines 8 from one output. Accordingly, in accordance with respective periods in which the video signal lines 8 are respectively selected, the second source driver 6 outputs the respective gray scale voltages to be outputted to respective selected video signal lines 8. That is, the second source line 6 outputs the gray scale voltages under time division.

For example, with the use of the distributing circuit 61-1 in FIG. 2, during a period that the second source driver 6 is connected to the video signal line 8-1, the gray scale voltage to be outputted to the video signal line 8-1 is outputted from the second source driver 6. Thereafter, sequentially, during a period that the second source driver 6 is connected to the video signal line 8-2, the gray scale voltage to be outputted to the video signal line 8-2 is outputted from the second source driver 6, and during a period that the second source driver 6 is connected to the video signal line 8-3, the gray scale voltage to be outputted to the video signal line 8-3 is outputted from the second source driver 6.

Figure 3:
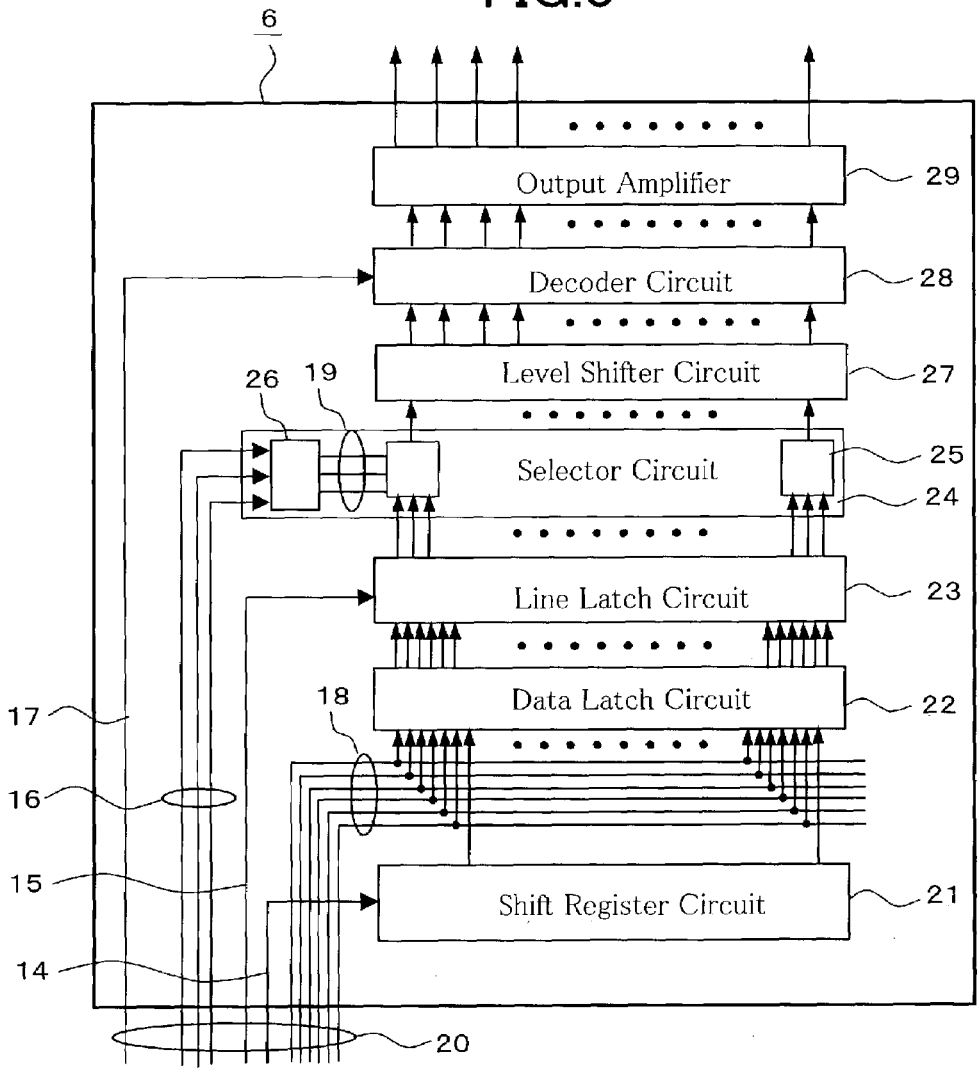
FIG. 3 is a schematic block diagram of a second source driver of the liquid crystal display device according to one embodiment of the present invention.

Subsequently, the inner constitution of the second source driver 6 is explained in conjunction with FIG. 3. FIG. 3 is a schematic block diagram of the second source driver 6. Numeral 20 indicates an input terminal and the display data outputted from the controller 3 are inputted to the input terminal 20 through the data bus lines 5 (shown in FIG. 1). Inner data bus lines 18 are connected to the input terminal 20. A second clock line 14 is connected to a shift register circuit 21. Clock signals CL2 are inputted from the controller 3 to the shift register circuit 21 through the second clock signal line 14. The shift register circuit 21 sequentially outputs timing signals in accordance with the clock signals CL2.

A data latch circuit 22 fetches the display data on the inner data bus lines 18 therein upon inputting of timing signals. The data latch circuit 22 sequentially fetches the display data therein in accordance with the timing signals and the display data are supplied to all data latch circuits 22. The display data are outputted to a line latch circuit 23 from the data latch circuit 22. A first clock signal line 15 is connected to the line latch circuit 23. A clock signal CL1 which is in synchronism with 1 horizontal scanning period (period in which 1 scanning signal line is held in an ON state, hereinafter also referred to as 1H) is inputted to the line latch circuit 23 through the first clock signal line 15. The line latch circuit 23 fetches the display data for 1 line therein in accordance with the clock signal CL1 and the fetched display data is outputted to a selector circuit 24.

That is, the number of display data which correspond to the video signal lines is inputted to the selector circuit 24. The selector circuit 24 is a circuit which allows the second source driver 6 to output the gray scale voltages under time division. The selector circuit 24 includes a data line selector circuit 25. Further, a time division control line 16 is provided to the second source driver 6 and time-division control signals are transmitted to the selector circuit 24. In a time-division signal generating circuit 26, time-division signals are prepared in response to the time division control signals and are outputted to the time-division signal lines 19. Here, although a case in which three time-division control lines 16 and three time-division signal lines 19 are provided is shown in FIG. 3, it is possible to adopt the constitution in which the signals are outputted from one time-division control line 16 to a plurality of time-division signal lines 19.

The time-division signal lines 19 are connected to each data line selector circuits 25. The time-division signals control the data line selector circuit 25. The data line selector circuit 25 allows the display data which the line latch circuit 23 outputs to be subjected to time division in accordance with the time-division signals and outputs the display data to a level shifter circuit 27 which constitutes a next stage. That is, although the line latch circuit 23 outputs the display data for 1 horizontal scanning period (1H), 1 horizontal scanning period is divided into a plurality of periods by the selector circuit 24, and the display data which are different for respective divided periods are transmitted to the level shifter circuit 27.

In the level shifter circuit 27, a voltage of the display data which constitutes a logic signal is converted and is outputted as a voltage which can be driven by a decoder circuit 28 which constitutes a next stage. In the decoder circuit 28, a gray scale voltage which follows the display data is selected and is inputted to an output amplifying circuit 29. The gray scale voltage 17 is prepared by dividing the reference voltage supplied through the gray scale voltage line. Further, in the output amplifying circuit 29, the gray scale voltage is subjected to an electric current amplifying and an amplified gray scale voltage is outputted to the liquid crystal display panel 1.

Figure 4:
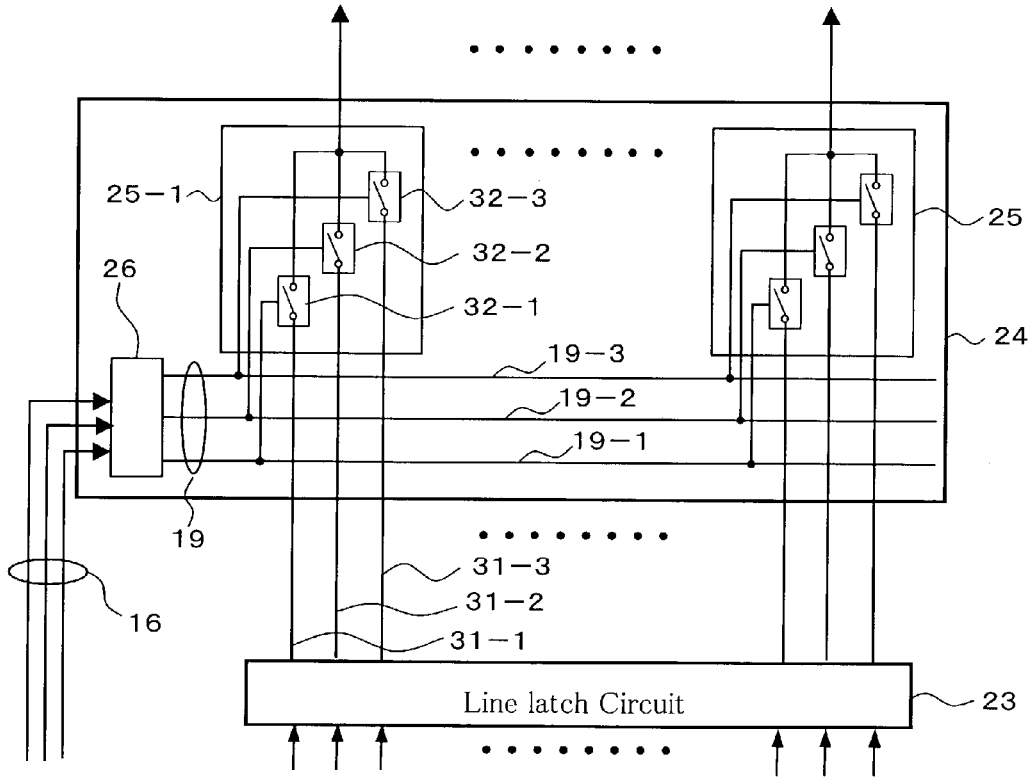
FIG. 4 is a schematic block diagram of a selector circuit of the liquid crystal display device according to one embodiment of the present invention.

Then, the selector circuit 24 is explained in conjunction with FIG. 4. To the selector circuit 24, display data lines 31 extended from the line latch circuit 23 are connected so that the display data are transmitted from the line latch circuit 23 to the selector circuit 24. Here, each display data includes the number of bits which correspond to the gray scale which the pixel displays. For example, the display data of 6 bits or 8 bits are transmitted from the line latch circuit 23 to the selector circuit 24. In FIG. 4, to simplify the drawing, the signal lines for a plurality of bits are indicated by one display data line 31. Hereinafter, the explanation is made assuming that one display data line 31 consists of signal lines for a plurality of bits.

The number of display data lines 31 which are outputted from the line latch circuit 23 corresponds to the number of pixels for one line of the liquid crystal display panel. Within 1 horizontal scanning period (1H), to one display data line 31 which is extended from the line latch circuit 23, the display data corresponding to the gray scale voltage written in one pixel electrode is outputted. The display data line 31 is connected to the data line selector circuit 25 of the selector circuit 24. With respect to the respective display data lines 31, a plurality of display data lines 31 are connected to the data line selector circuit 25 as a set.

In FIG. 4, three display data lines 31-1, 31-2, 31-3 are connected to an input terminal of the data line selector circuit 25 as a set. The data line selector circuit 25 is controlled through the time-division signal lines 19 and one of a plurality of display data lines 31 is connected to the level shift circuit 27 which constitutes a next stage. For example, the data line selector circuit 25-1 is controlled through the time-division signal line 19-1, and during a fixed period of 1 horizontal scanning period (1H), the display data line 31-1 is connected to the level shifter circuit 27 which constitutes the next stage. Further, the display data lines 31-2, 31-3 are sequentially connected to the level shifter circuit 27 which constitutes the next stage time-sequentially during the fixe period.

Figure 5:
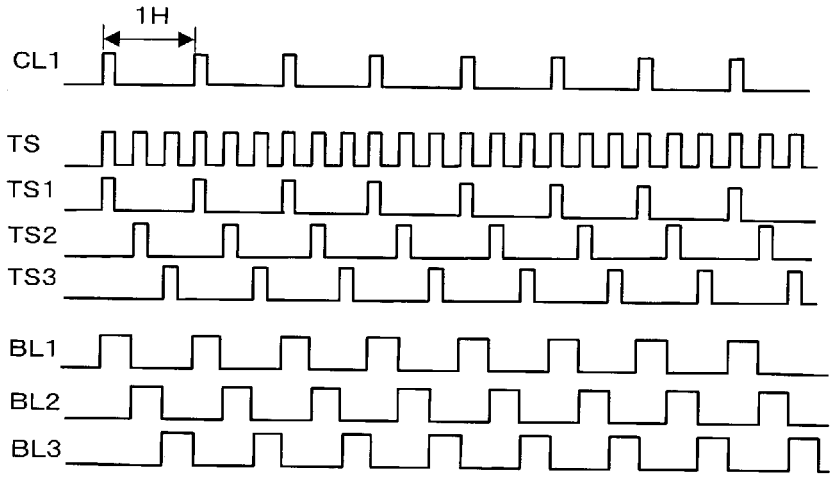
FIG. 5 is a schematic timing chart showing the driving of the selector circuit of the liquid crystal display device according to one embodiment of the present invention.

FIG. 5 shows the time-division control signals TS and the time-division signals BL1 to BL3. In FIG. 5, the first clock signal CL1 indicates 1 horizontal scanning period 1H. The time-division control signal T5 is a signal served for dividing 1 horizontal scanning period 1H and is inputted to the time-division signal generating circuit 26 shown in FIG. 4. The time-division signal generating circuit 26 generates the time-division signals BL1, BL2, BL3 in response to the time-division control signals TS and outputs these signals to the time-division signal lines 19. Here, FIG. 5 shows a case in which 1 horizontal scanning period 1H is divided into three periods by time division, wherein the time-division signal BL1 is outputted to the time-division signal line 19-1, the time-division signal BL2 is outputted to the time-division signal line 19-2, and the time-division signal BL3 is outputted to the time-division signal line 19-3. Further, when three time-division control signal lines 16 are provided, the time-division control signal TS is transmitted as the time-division control signals TS1 to TS3.

As shown in FIG. 4, respective time-division signal lines 19 are connected to the switching circuits 32. The switching circuit 32-1 assumes the ON state when the time-division signal line 19-1 is in the HIGH state and outputs the data of the display data line 31-1. Hereinafter, the switching circuit 32-2 outputs the data of the display data line 31-2 when the time-division signal line 19-2 is in the HIGH state and the switching circuit 32-3 outputs the data of the display data line 31-3 when the time-division signal line 19-3 is in the HIGH state.

As mentioned above, the signals which are obtained by dividing the 1 horizontal scanning period 1H using time-division in response to the time-division control signals TS are transmitted during the divided period, and one of a plurality of display data which the line latch circuit 23 outputs is outputted from the selector circuit 24. Further, by time-sequentially inputting the time-division signals to the selector circuit 24, it is possible to output the display data of the line latch circuit 23 time-sequentially.

Figure 6:
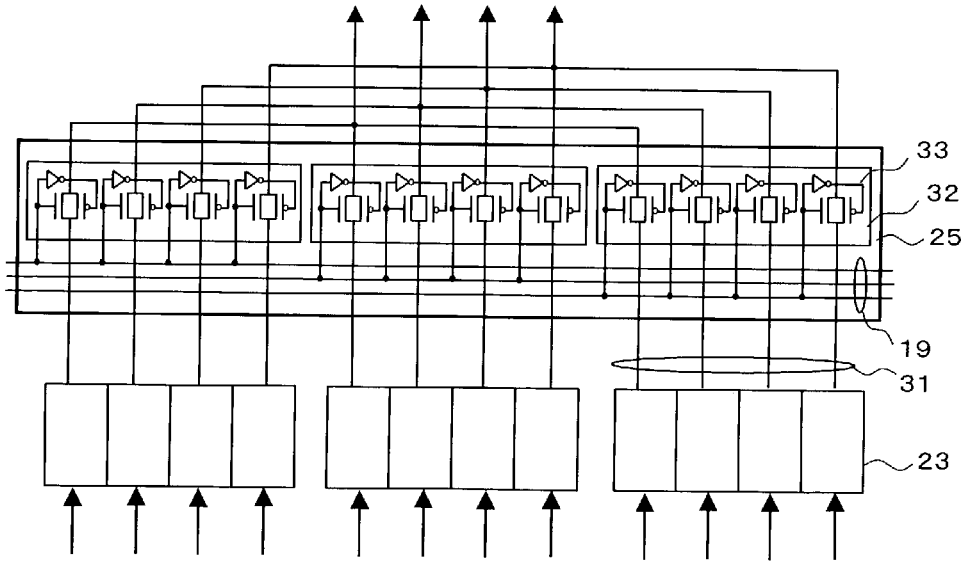
FIG. 6 is a schematic block diagram of a selector circuit of the liquid crystal display device according to one embodiment of the present invention.

FIG. 6 is a schematic block diagram showing the data line selector circuit 25 of the selector circuit 24 when the display data is of 4 bits. The display data of 4 bits are outputted from the line latch circuit 23. The switching circuit 32 includes an analogue switch 33 for every bit. Every switching circuit 32 is connected to the same time-division signal line 19, while each analogue switch 33 is controlled by the time-division signal to divide the display data by time-division and divided display data are outputted to the circuit which constitutes a next stage. Here, while the number of inputs from the line latch circuit 23 is 12 (3×4), the number of outputs from the data line selector circuit 25 is 4. By dividing the display data by time-division and outputting divided display data using the selector circuit 24, it is possible to decrease the number of circuit constitutions after the selector circuit 24.

Figure 7:
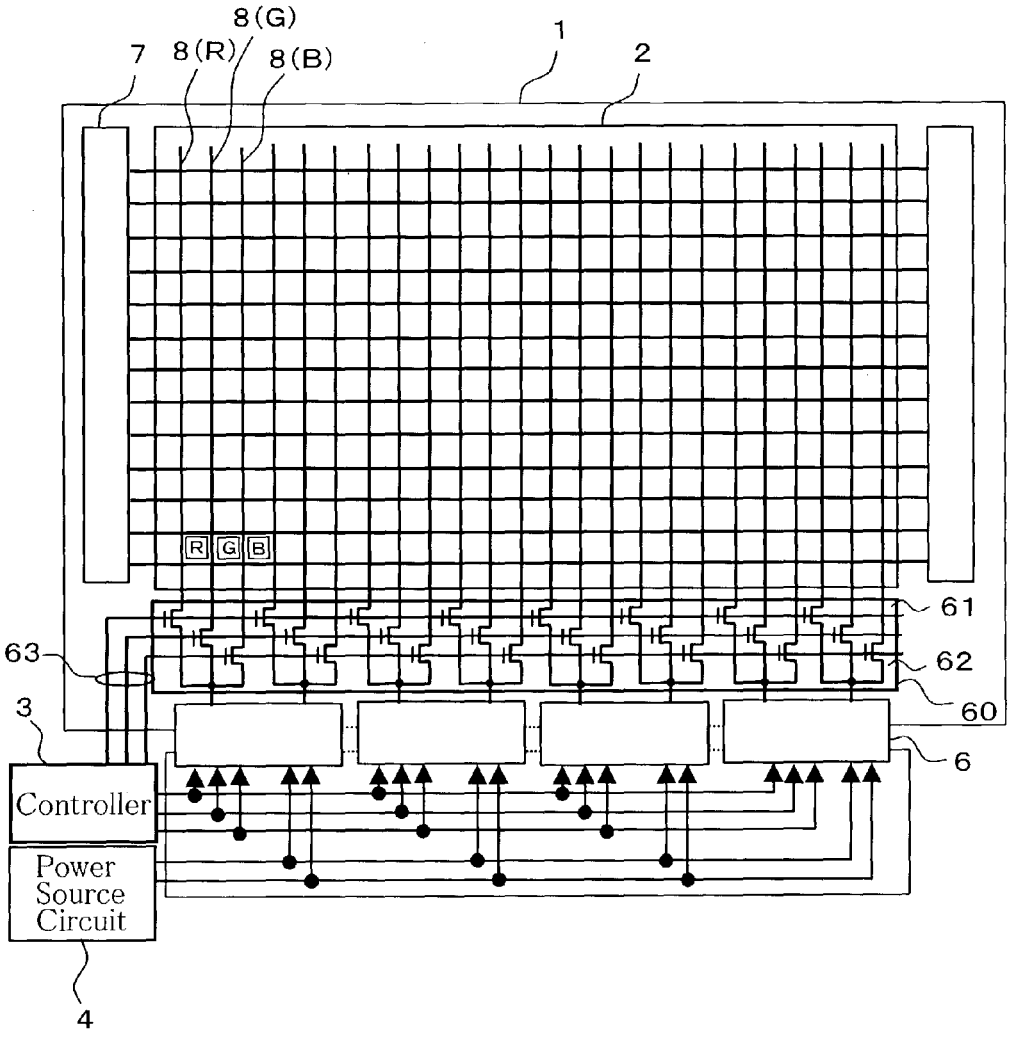
FIG. 7 is a schematic block diagram showing the schematic constitution of the liquid crystal display device according to one embodiment of the present invention.

Then, the constitutions of the first source driver 60 and the liquid crystal display panel 1 are explained in conjunction with FIG. 7. The first source driver 60 includes the distributing transistors 62 which constitute switching elements. The distributing transistor 62 is constituted of a semiconductor having the same conductive type as a thin film transistor 10 (not shown in the drawing) which is provided to the pixel portion. By using the transistor having the same conductive type as that of the pixel portion, it is possible to reduce the number of manufacturing steps. The distributing control signal line 63 is connected to a gate terminal of the distributing transistor 62 and the distributing transistor 62 is subjected to an ON/OFF control in response to the distributing control signals. By making the distributing transistor 62 electrically conductive, the output of the second source driver 6 and the video signal line 8 are connected.

For example, when the respective pixels are arranged in the order of red (R), green (G), blue (B) from the left in the drawing, 1 horizontal scanning period 1H from the second source driver 6 is divided in three periods by time division, and the gray scale voltages are sequentially outputted in the order of red (R), green (G), blue (B). During a period that the gray scale voltage of red (R) is outputted, the distributing transistor 62 connects the video signal line 8 (R) for red (R) pixel with the output terminal of the second source driver 6. Hereinafter, in the same manner, during a period that the gray scale voltage of green (G) is outputted, the distributing transistor 62 connects the video signal line 8 (G) for green (G) pixel with the output terminal of the second source driver 6, while during a period that the gray scale voltage of blue (B) is outputted, the distributing transistor 62 connects the video signal line 8 (B) for blue (B) pixel with the output terminal of the second source driver 6.

By mounting the first source driver 60 on the liquid crystal display panel 1, it is possible to reduce the scale of the circuits of the second source drivers 6. Further, since it is possible to decrease the number of output terminals of the second source drivers 6, it is possible to enhance the reliability of the connection between the second source driver 6 and the liquid crystal display panel 1. However, the necessity to supply the distributing control signals from the controller 3 to the liquid crystal display panel newly arises and hence, it is necessary to take the distributing control signal line arranged between the controller 3 and the liquid crystal display panel 1 into consideration.

Figure 8:
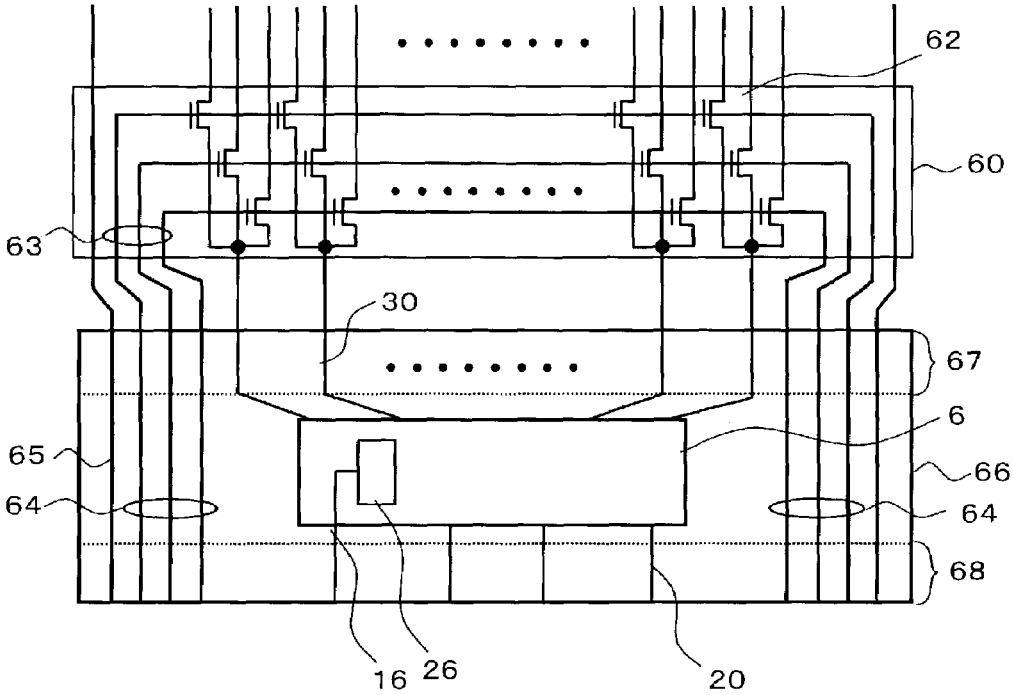
FIG. 8 is a schematic block diagram showing the connection between the second source driver and a first source driver of the liquid crystal display device according to one embodiment of the present invention.

FIG. 8 shows the constitution in which the second source driver 6 is mounted using a TCP (Tape Carrier Package). Numeral 66 indicates a flexible board. The second source driver 6 is a silicon chip which is manufactured in the same manner as a general semiconductor integrated circuit and is connected to wiring (inner leads) formed on the flexible board 66. The wiring, input terminals 20 and output terminals 30 are formed on the flexible board 66 using copper foils or the like. Terminals are also formed on the liquid crystal display panel side such that these terminals face the output terminals 30, wherein the output terminals 30 and the liquid crystal display panel-side terminals are connected to each other. As mentioned previously, the first source driver 60 is mounted on the liquid crystal display panel and the outputs of the second source drivers 6 are transmitted to the first source driver 60 through the output terminals 30 formed on the flexible board 66. The output terminals 30 are configured such that a large number of terminals are arranged in parallel along a side extending in the lateral direction of the flexible board 66 in the drawing so as to constitute an output terminal portion 67.

As mentioned previously, numeral 20 indicates the input terminals. The signals, the power supply voltages and the like which are to be supplied to the second source driver 6 from an external device or the like are inputted to the second source driver 6 through the input terminals 20. The input terminals 20 also form an input terminal portion 68 in the same manner as the output terminals 30. Numeral 16 indicates the time-division control line as mentioned previously. The time-division control line 16 has one end thereof connected to one of the input terminals 20 and the other end thereof connected to the time-division signal generating circuit 26 in the inside of the second source driver 6. In this manner, with respect to the second source driver 6 mounted using the TCP, the signals are inputted from the input terminal portion 68 and are supplied to the second source driver 6, while the signals which drive the liquid crystal display panel are outputted from the second source driver 6 and are transmitted to the liquid crystal display panel 1 from the output terminal portion 67.

Among the wiring formed on the flexible board 66, the counter electrode signal line 65 is directly connected to the output terminal 30 from the input terminal 20 without being connected to the second source driver 6. The counter electrode signal line 65 is served for supplying the signals to the above-mentioned counter electrode. In FIG. 8, besides the counter electrode signal line 65, the distributing control signal is also inputted from the input terminal 20 through the distributing control signal line 64 and is outputted from the output terminal 30 without being inputted to the second source driver 6. As shown in FIG. 8, the distributing control signals are transmitted to the liquid crystal display panel side through the distributing control signal lines 64 formed on the flexible board 66.

Figure 9:
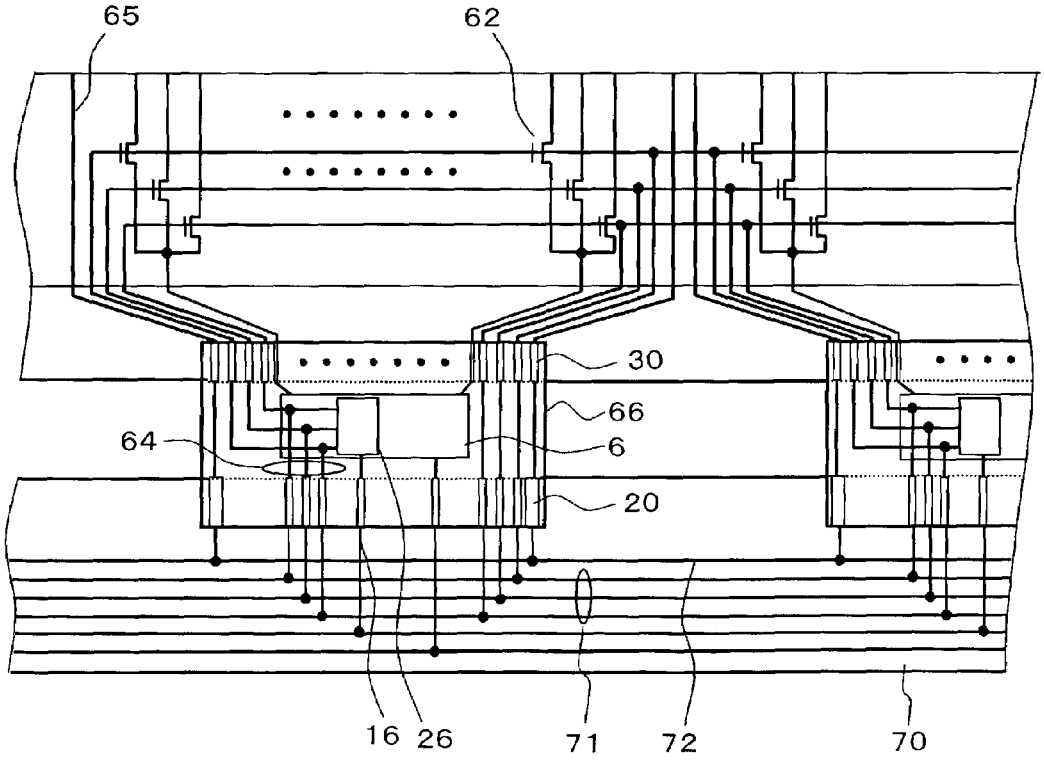
FIG. 9 is a schematic block diagram showing the connection between the second source driver and the first source driver of the liquid crystal display device according to one embodiment of the present invention.

Then, a case in which the distributing control signals are inputted to the second source driver 6 through the distributing control signal lines 64 is explained in conjunction with FIG. 9. With respect to the second source driver 6 shown in FIG. 9, to refer to the distributing control signals, the distributing control signal lines 64 are connected to the second source driver 6. However, when the wiring in the flexible board 66 adopts the multi-layered wiring structure, the structure pushes up a cost and hence, the lines are configured to -cross each other in the second source driver 6.

Here, in FIG. 9, the output terminals 30 which are connected to the distributing signal lines 64 have a width larger than a width of the output terminals 30 through which the gray scale voltages are outputted. Further, the output terminals which are connected to the counter electrode signal lines 65 also have a large width in the same manner. The output terminals which are connected to the distributing signal lines 64 and the counter electrode signal lines 65 are positioned at the outside with respect to other terminals and hence, the output terminals have a drawback that the output terminals are liable to be easily peeled off. Accordingly, the width of the terminals are widened for the purpose of increasing the contact area. Here, the output terminals 30 and the liquid crystal display panel are connected using an anisotropic conductive film or the like.

In FIG. 9, numeral 70 indicates a printed wiring board on which wiring is formed using a copper foil or the like. Numeral 71 indicates distributing control signal lines which are formed on the printed wiring board 70 for transmitting distributing control signals to the liquid crystal display panel using the flexible board 66. By supplying the distributing control signals using the printed wiring board 70, it is possible to supply the signals with the least waveform deformation attributed to wiring resistance or the like to the liquid crystal display panel. Here, numeral 72 indicates the counter electrode signal lines which are formed on the printed wiring board 70. Further, the input terminals 20 and the printed wiring board 70 are connected to each other by an anisotropic conductive film, soldering or the like.

Figure 10:
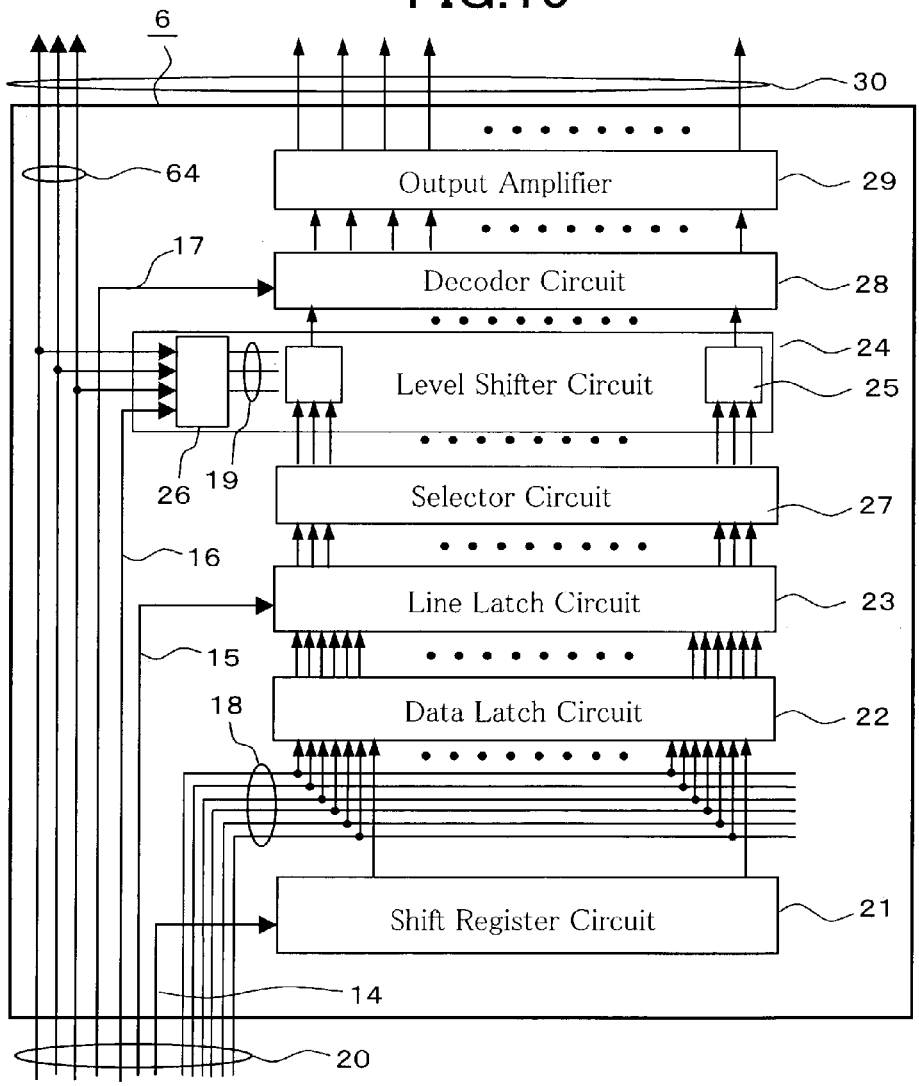
FIG. 10 is a schematic block diagram of a second source driver of the liquid crystal display device according to one embodiment of the present invention.

FIG. 10 shows the constitution in which the second source driver 6 refers to the distributing control signals. The distributing control signals are inputted to the second source driver 6 from the input terminals 20. The distributing control signals are supplied to the time-division signal generating circuit 26 from the distributing control signal lines 64. Further, the distributing control signals are outputted to the outside from the output terminals through the distributing control signal lines 64 and are supplied to the liquid crystal display panel. As mentioned previously, the distributing control signal lines 64 cross each other on the semiconductor chip which forms the second source driver 6. The formation of the multi-layered wiring on the semiconductor chip can be realized using the usual semiconductor process and hence, it is possible to manufacture the multi-layered wiring at a lower cost than the wiring which intersects the distributing control signal lines 64 on the flexible wiring board.

By referring to the distributing control signals in the time-division signal generating circuit 26, it is possible to adjust the relationship between the time-division signals and the distributing control signals. Here, in FIG. 10, the constitution in which the selector circuit 24 is provided at a stage behind the level shifter circuit 27 is shown. When the voltage of the distributing control signals and the voltage of the signals outputted from the level shifter circuit 27 assume substantially the same value, it is possible to omit a step to convert the distributing control signals to a low voltage by arranging the selector circuit 24 at a stage behind the level shifter circuit 27.

However, when the selector circuit 24 is arranged at a stage behind the level shifter circuit 27, the number of level shifter circuits 27 cannot be decreased. The circuit shown in FIG. 10 can be effectively used in a case although the number of level shifter circuits 27 cannot be decreased, the operational frequency is increased and the level shifter circuit 27 cannot follow the increase of the operational frequency.

Figure 11:
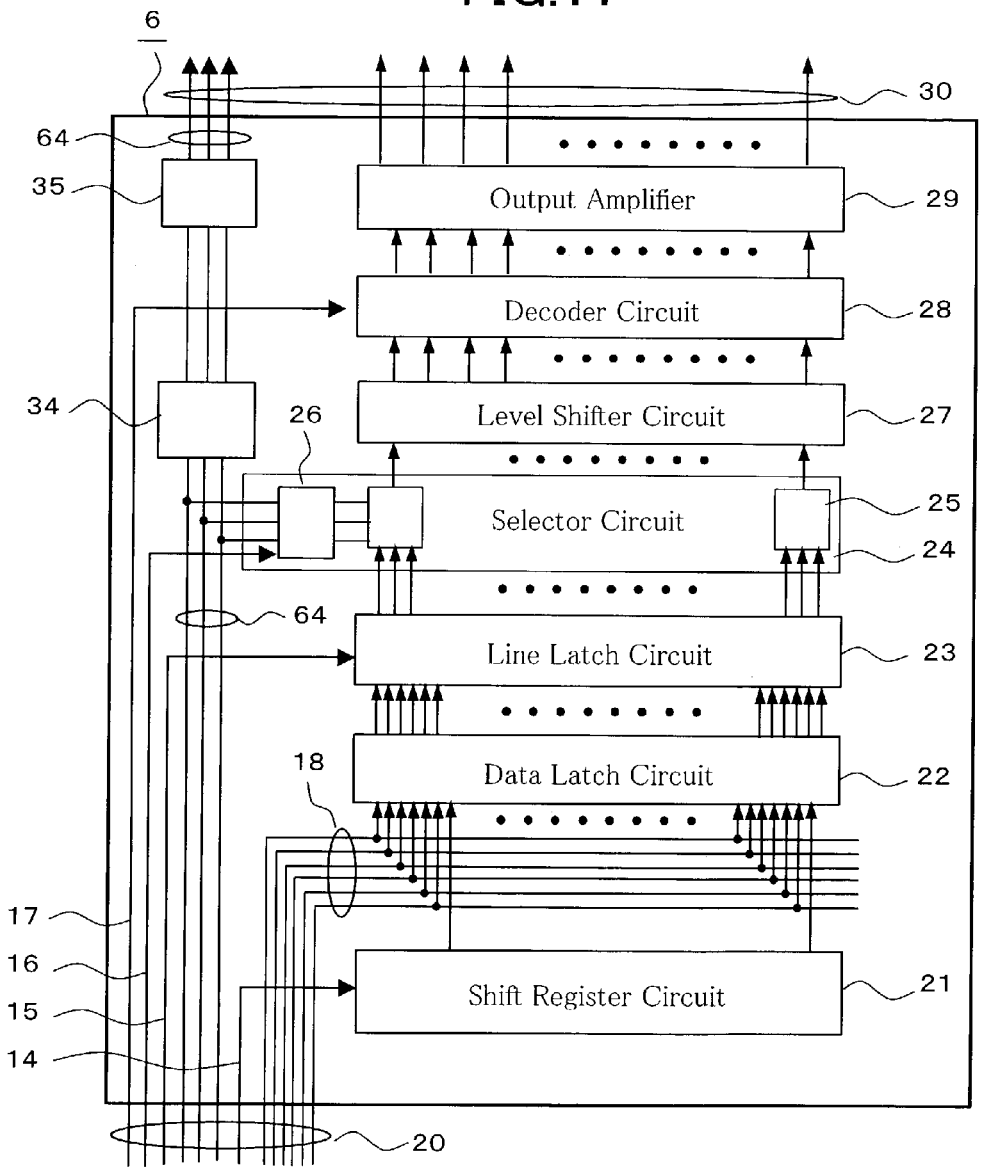
FIG. 11 is a schematic block diagram of a second source driver of the liquid crystal display device according to one embodiment of the present invention.

FIG. 11 shows the constitution in which the distributing control signals are supplied as logic signals having a low voltage similar to that of the output from the line latch circuit 23. Numeral 34 indicates a level shifter circuit and converts the distributing control signals to a voltage which the distributing transistors 62 can drive. An output of the level shifter circuit 34 is inputted to an output circuit 35. In the liquid crystal display panel 1, a large number of distributing transistors 62 are formed. In the output circuit 35, an electric current is amplified to enable driving of the distributing transistor 62.

In the circuit shown in FIG. 11, the distributing control signals of low voltage are inputted to the time-division signal generating circuit 26 and hence, the distributing control signals can be referred. In the second transistor 6, when the distributing control signals are formed in such a manner that the signals can be referred, it is possible to adjust the relationship between the time-division signals and the distributing control signals.

Figure 12:
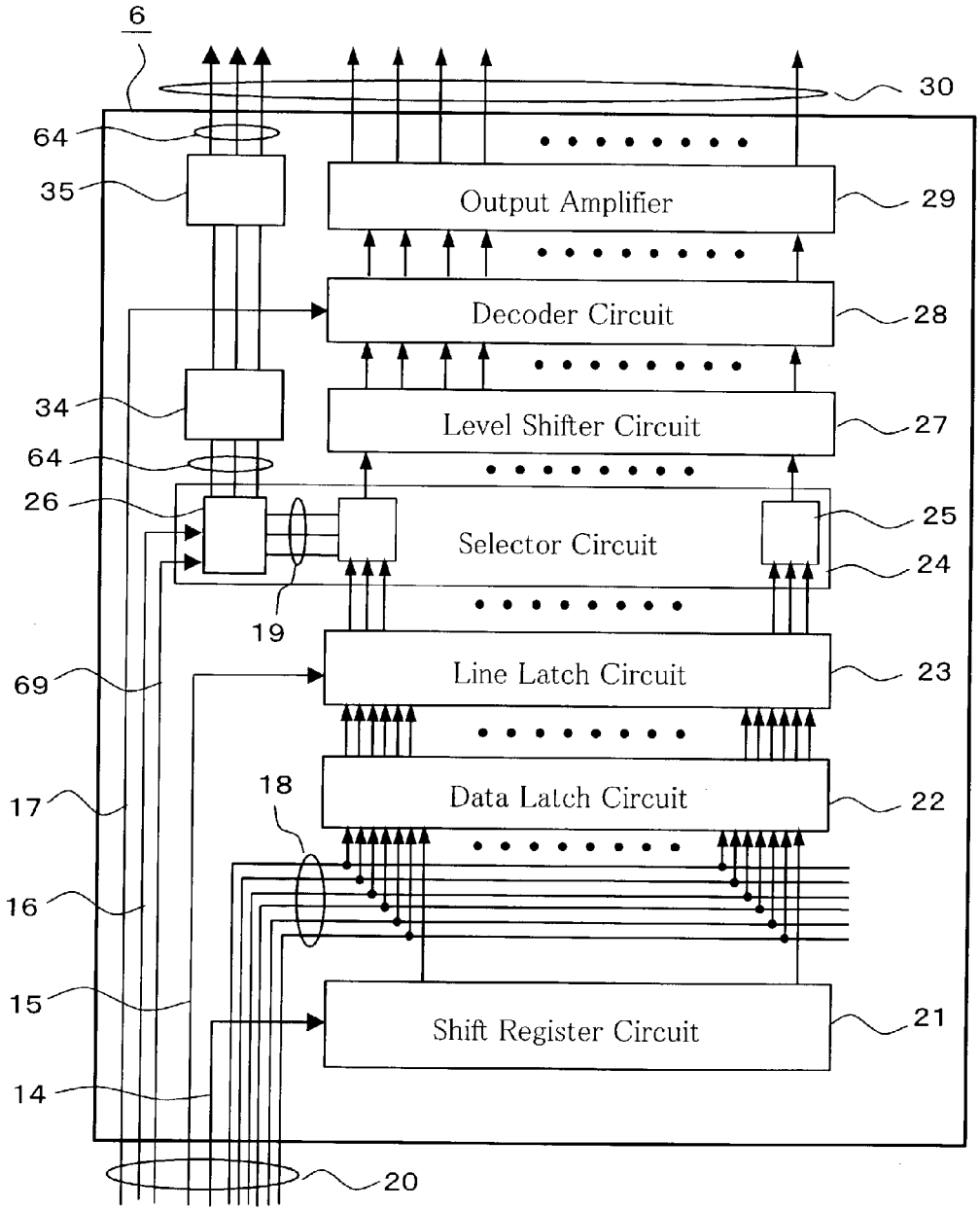
FIG. 12 is a schematic block diagram of a second source driver of the liquid crystal display device according to one embodiment of the present invention.

FIG. 12 shows the circuit constitution when the distributing control signals are also formed in the time-division signal generating circuit 26. A time division control signal is inputted to the time-division signal generating circuit 26 through the time division control signal line 16. The time-division signal generating circuit 26 generates the time-division signals and the distributing control signals from time division control signals. Numeral 69 indicates a mode set line which sets timings for outputting the time-division signals and the distributing control signals based on the time-division control signals. From the time-division signal generating circuit 26, the time-division signals and the distributing control signals are outputted through the time-division signal lines 19 and the distributing control signal lines 64. The time-division signals are inputted to the data line selector circuit 25 and control respective switching circuits 32 (not shown in the drawings) through the time-division signal lines 19. On the other hand, the distributing control signals are inputted to the level shifter circuit 34 through the distributing control signal lines 64. The level shifter circuit 34 converts the voltage level of the distributing control signals outputted from the time-division signal generating circuit 26.

The output of the level shifter circuit 34 is inputted to the output circuit 35. In the liquid crystal display panel 1, a large number of distributing transistors 62 are formed. In the output circuit 35, an electric current is amplified to enable driving of the distributing transistor 62.

The second source driver 6 shown in FIG. 11 and FIG. 12 includes the output circuit 35 which drives the distributing transistors 62 and hence, it brings about an advantageous effect that it is possible to drive the distributing transistors 62 mounted on the liquid crystal display panel 1 by the second source drivers 6 which supply signals to the thin film transistors 10 formed on the pixel portions. However, when a plurality of second source drivers 6 are mounted on the liquid crystal display panel 1, there arises a problem that the difference is generated among loads driven by the second source drivers 6.

That is, assuming the second source driver which drives the distributing transistor 62 and the second source driver which does not drive the distributing transistor 62, there arises the difference with respect to the loads driven between these second source drivers. When the difference arises between the loads which are driven by the second source drivers, this gives rise to a problem that the power supply voltage is fluctuated, for example.

Figure 13:
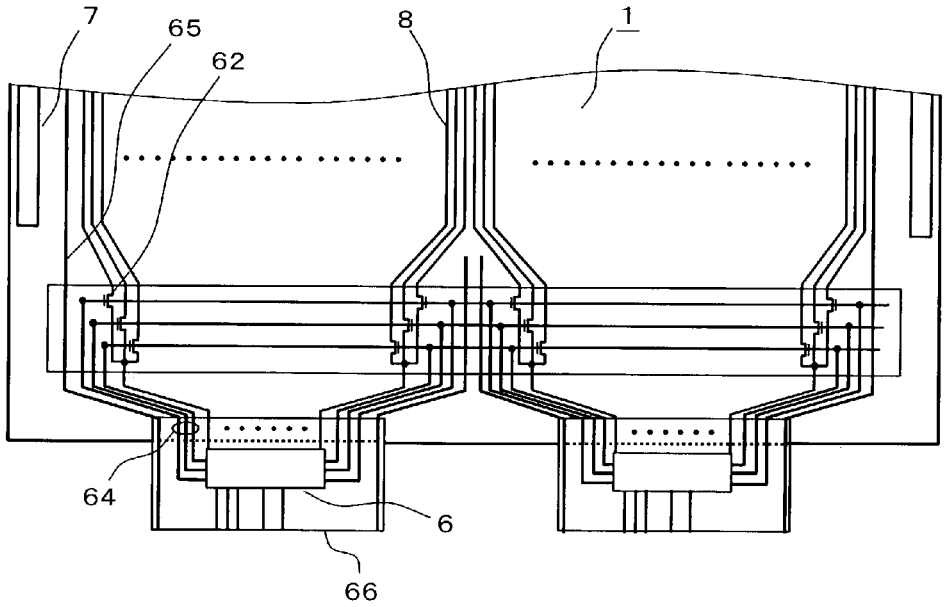
FIG. 13 is a schematic block diagram showing the connection between the second source driver and a first source driver of the liquid crystal display device according to one embodiment of the present invention.

To solve such a problem, as shown in FIG. 13, when a plurality of second source drivers 6 are mounted on the liquid crystal display panel 1, each second source driver 6 is configured such that the second source driver 6 can drive the distributing transistor 62. In the second source driver 6 shown in FIG. 13, the distributing control signal lines 64 are outputted from both sides, that is, left and right sides of the flexible board 66.

Since the wiring is provided to the flexible board 66 such that the distributing transistor 62 can be driven from both sides, that is, from left and right sides of the flexible board 66, the second source drivers 6 can be mounted on both sides, that is, left and right sides of the liquid crystal display panel 1 with the use of the same flexible boards 66. Here, outside the distributing control signal lines 64, a counter electrode signal line 65 is formed. The counter electrode signal line 65 is a line which supplies signals to the counter electrode and is connected to the counter electrode in the liquid crystal display panel 1 although not shown in the drawing. In the TFT liquid crystal display device of the vertical field type, the counter electrodes are formed on a substrate which faces the substrate on which the pixel electrodes are formed in an opposed manner, while in the TFT liquid crystal display device of the lateral field type, the counter electrodes are formed on the same substrate on which the pixel electrodes are formed.

Figure 14:
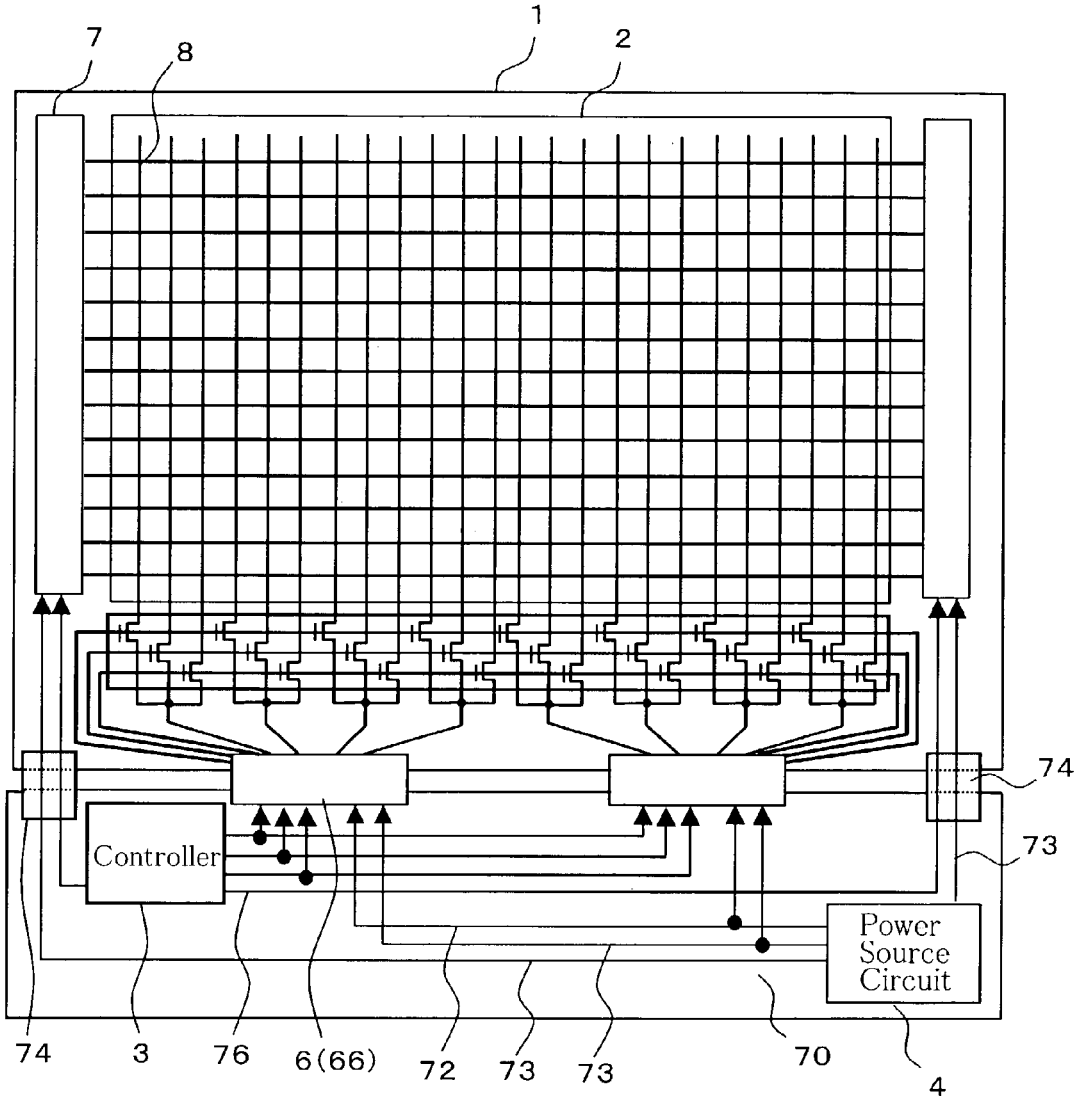
FIG. 14 is a schematic block diagram showing the schematic constitution of the liquid crystal display device according to one embodiment of the present invention.

Subsequently, the wiring which supplies signals to the gate driver 7 is explained in conjunction with FIG. 14. The second source driver 6 is mounted on the flexible board 66 and is connected to the liquid crystal display panel 1. Further, input terminals 20 (not shown in the drawing) of the second source driver 6 are connected to a printed wiring board 70. The power supply circuit 4 and the controller 3 are mounted on the printed wiring board 70. A power supply voltage is outputted from the power supply circuit 4 through a power supply line 73 and timing signals are outputted from the controller 3 through timing signal lines 76. The power supply line 73 and the timing signal lines 76 are connected to the liquid crystal display panel 1 through the flexible board 74 so that the power supply voltage and the timing signals can be inputted to the gate driver 7.

Figure 15:
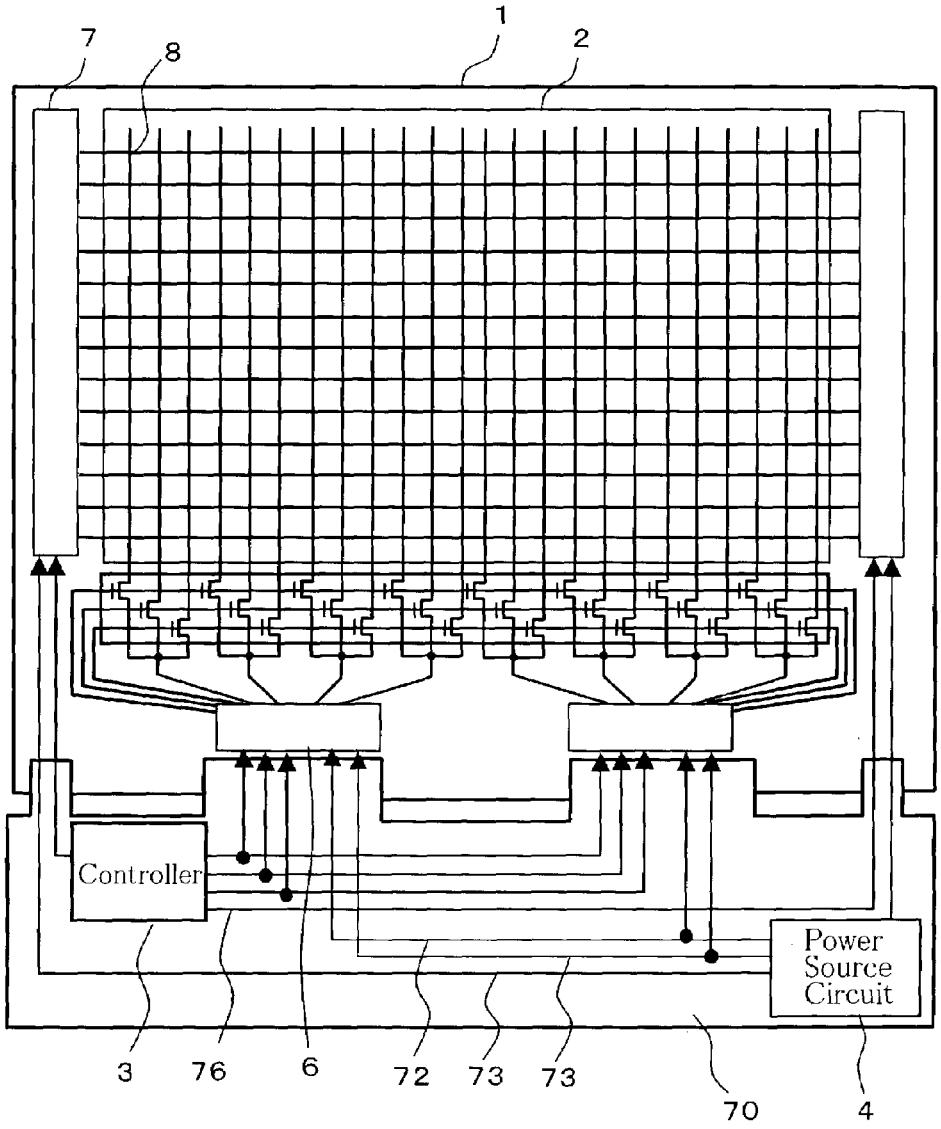
FIG. 15 is a schematic block diagram showing the schematic constitution of the liquid crystal display device according to one embodiment of the present invention.

FIG. 15 shows a case in which the second source drivers 6 are mounted on the liquid crystal display panel 1. Assuming terminal pads (not shown in the drawing) formed on the second source drivers 6 as the input terminals 20 or the output terminals 30, the second source drivers 6 are connected to the liquid crystal display panel 1 using anisotropic conductive films or the like. The printed wiring board 70 is wholly or partially formed of a flexible board and is connected to the liquid crystal display panel 1 using an anisotropic conductive film or the like. Signals supplied from the printed wiring board 70 are inputted to the second source driver 6 and the gate driver 7. Particularly, the distributing control signals which are inputted to the first source driver 60 are also supplied to the liquid crystal display panel 1 using the printed wiring board 70.

Figure 16:
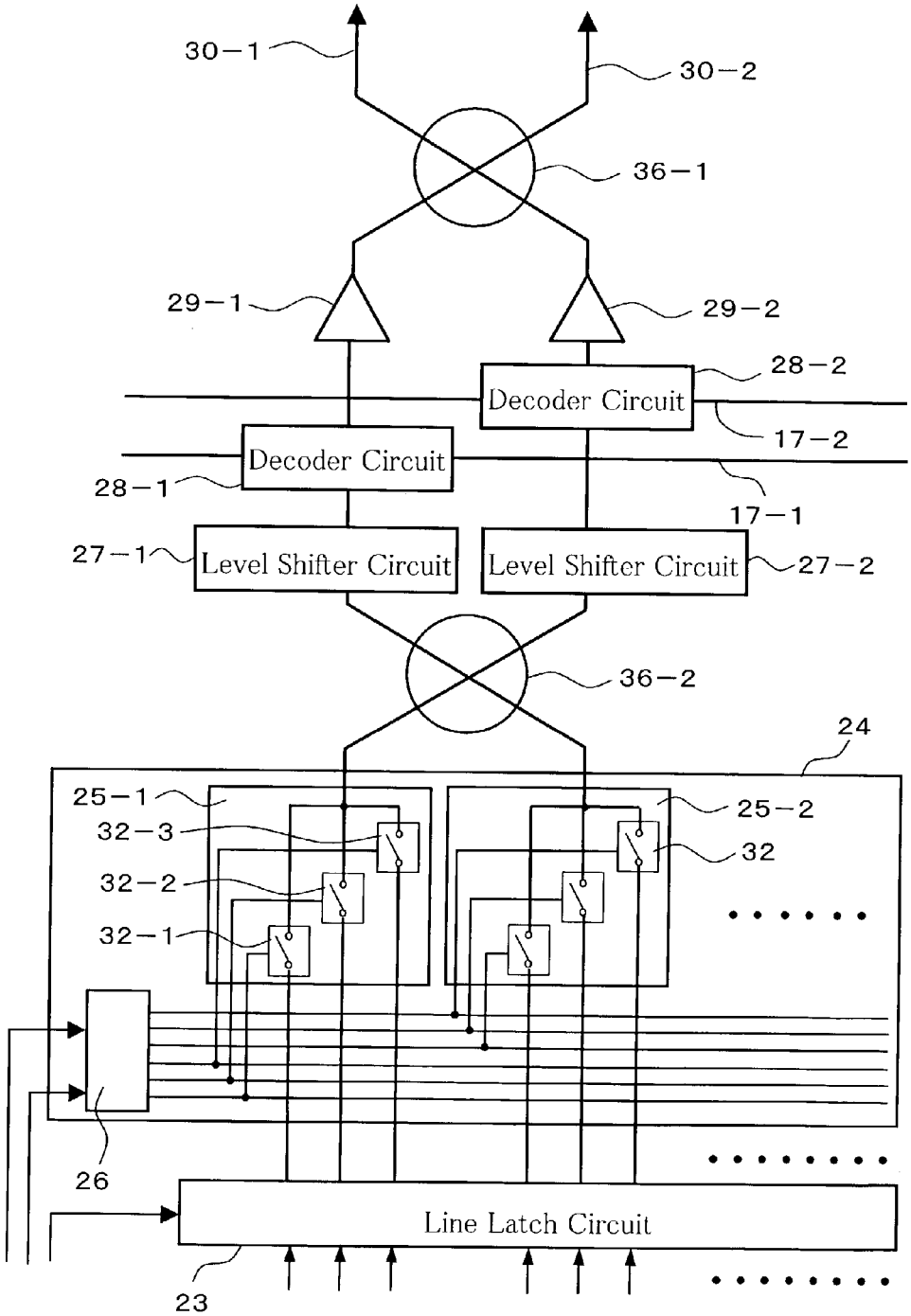
FIG. 16 is a schematic block diagram showing a second source driver of the liquid crystal display device according to one embodiment of the present invention.

Then, the circuit constitution which performs the AC driving is explained in conjunction with FIG. 16. FIG. 16 shows output portions of two neighboring output terminals 30-1 and 30-2 of the second source driver. Numeral 29-1 indicates a high voltage output amplifier (a high dielectric strength amplifier) and numeral 29-2 indicates a low voltage output amplifier (a low dielectric strength amplifier). In the AC driving in which the voltage of the counter electrodes (hereinafter referred to as "common voltage") is fixed, the gray scale voltage which takes the positive polarity with respect to the common voltage and the gray scale voltage which takes negative polarity with respect to the common voltage are applied to the pixel electrodes. In the circuit shown in FIG. 16, the gray scale voltage of positive polarity is outputted from the high voltage output amplifier 29-1 and the gray scale voltage of negative polarity is outputted from the low voltage output amplifier 29-2.

In FIG. 16, the outputs of the high voltage output amplifier 29-1 and the low voltage output amplifier 29-2 are changed over using the changeover switch 36-1. Here, in outputting the gray scale voltage of positive polarity from the output terminal 30-1, a changeover switch 36-1 connects the high voltage output amplifier 29-1 with the output terminal 30-1. Another output terminal 30-2 is connected to the low voltage output amplifier 29-2 so as to output the gray scale voltage of negative polarity. The changeover switch 36-2 changes over the output of the data line selector circuit 25 and the output is connected to the level shifter circuit 27. With the use of the changeover switch 36-2, the data line selector circuit 25-1 can be connected with both of the level shifter circuits 27-1 and 27-2.

Figure 17:
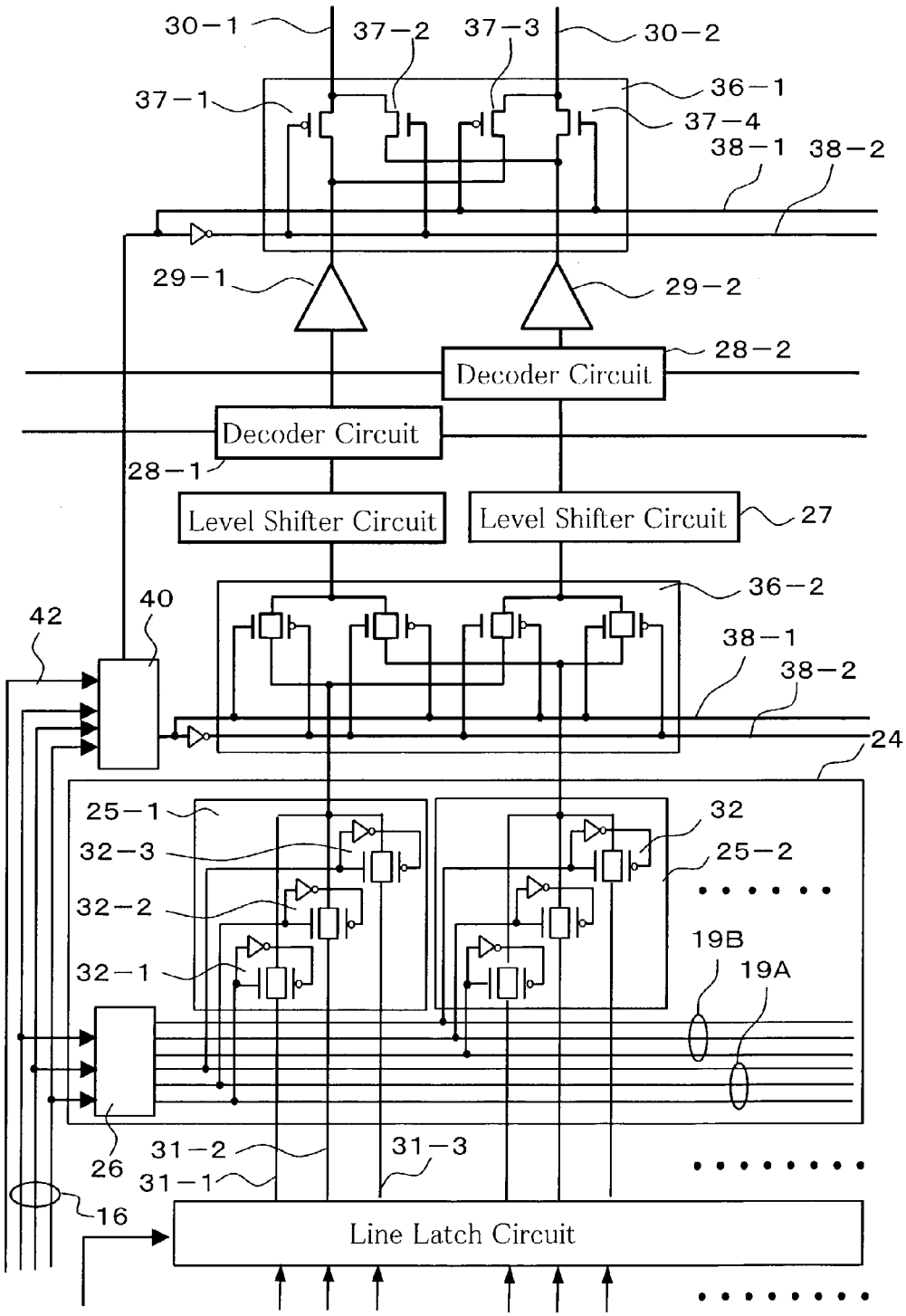
FIG. 17 is a schematic block diagram showing a second source driver of the liquid crystal display device according to one embodiment of the present invention.

FIG. 17 shows a circuit in which the changeover switch 36 is constituted of transistors 37. Numeral 38 indicates changeover signal lines which perform an ON/OFF control of the transistors 37. Here, although the display data line 31 is indicated by one signal line, it is assumed that the number of display data lines 31 correspond to the number of bits of the display data.

To explain the operation using the changeover switch 36-1, when the changeover signal line 38-1 is HIGH and the changeover signal line 38-2 is LOW, the transistor 37-1 assumes an ON state so that an output of the output amplifier 29-1 is connected to an output terminal 30-1. Here, the transistor 37-2 is turned off. Further, since the changeover signal line 38-1 is HIGH, the transistor 37-4 is turned on and the transistor 37-3 is turned off, and an output of the output amplifier 29-2 is connected to the output terminal 30-2.

On the other hand, when the changeover signal line 38-1 is LOW and the changeover signal line 38-2 is HIGH, the output amplifier 29-1 is connected to the output terminal 30-2 and the output amplifier 29-2 is connected to the output terminal 30-1. Here, in FIG. 17, numeral 40 indicates a changeover signal control circuit which generates a changeover signal MS based on time-division control signals TS1 to TS3 transmitted through the time-division control signal line 16 and an AC signal M transmitted through an AC signal line 42 and outputs the changeover signal MS to a changeover signal line 38.

Figure 18:
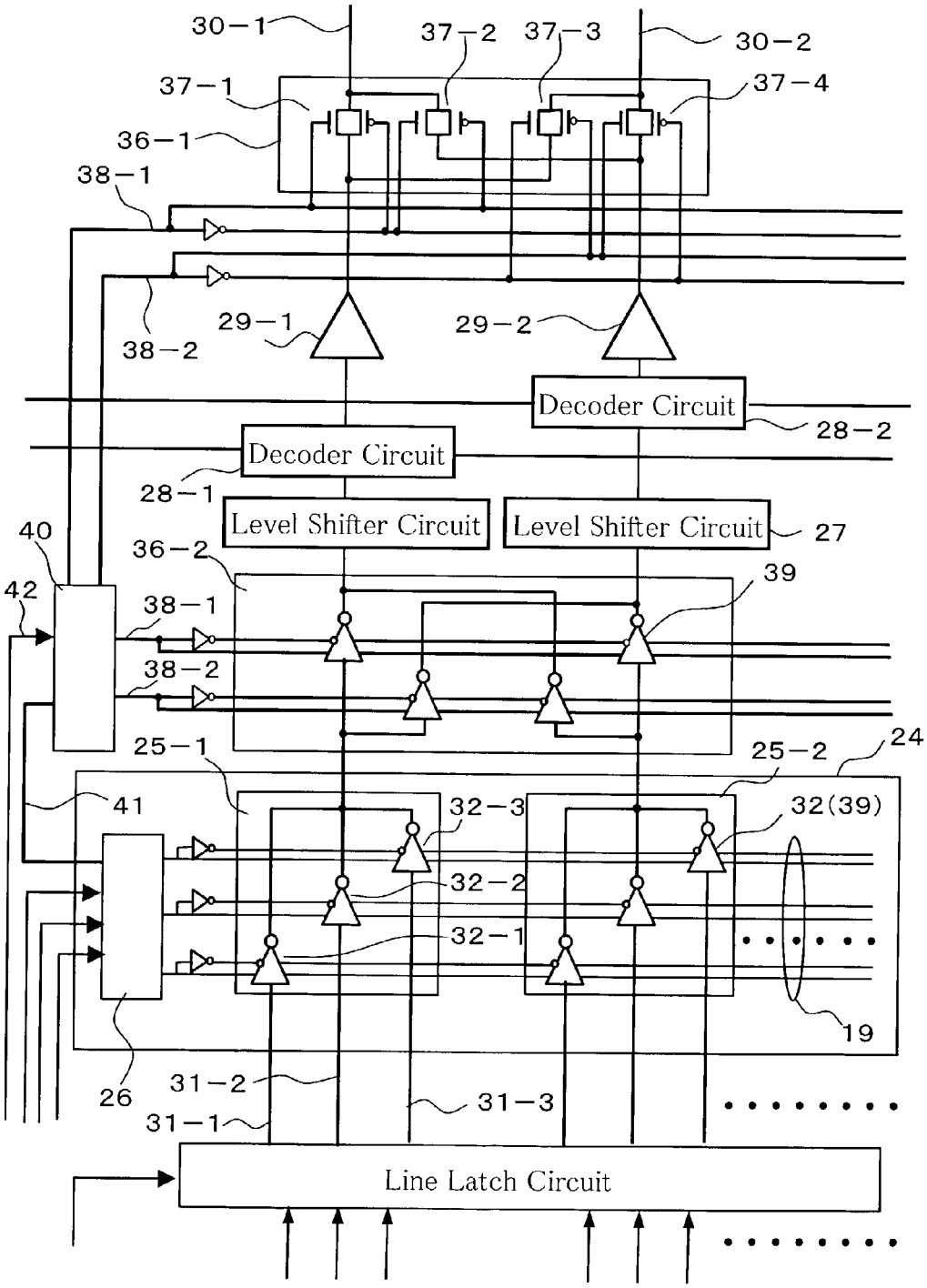
FIG. 18 is a schematic block diagram showing a second source driver of the liquid crystal display device according to one embodiment of the present invention.

FIG. 18 shows a circuit in which the changeover switch 36-2 and the switching circuit 32 are constituted of clocked inverters 39. Numeral 38 indicates the changeover signal line which performs an ON/OFF control of the clocked inverter 39. Here, although the display data line 31 is indicated by one signal line, it is assumed the number of display data lines 31 corresponds to the number of bits of the display data.

To explain the operation using the changeover switch 36-2, the clocked inverter 39 functions as an inverter when the changeover signal line 38-1 is HIGH and assumes high impedance when the changeover signal line 38-1 is LOW. The changeover switch 36-2 and the selector circuit 24 use the digital data and it is possible to perform the changeover between the connection and the disconnection of the signal line by the clocked inverters.

In FIG. 18, the changeover signal lines 38-1 and 38-2 are individually connected to the changeover switch 36-1 so that it is possible to simultaneously turn off analogue switches 37-1 to 37-4. With the use of the time-division control signals TS1 to TS3 shown in FIG. 5, it is possible to cut the output of the output amplifying circuit 29 by the changeover switch 36-1 for a fixed rise period of the time-division signals BL1 to BL3. When the output is cut, a load is reduced in the output amplifying circuit 29 and hence, it is possible to rapidly stabilize the output voltage.

Figure 19:
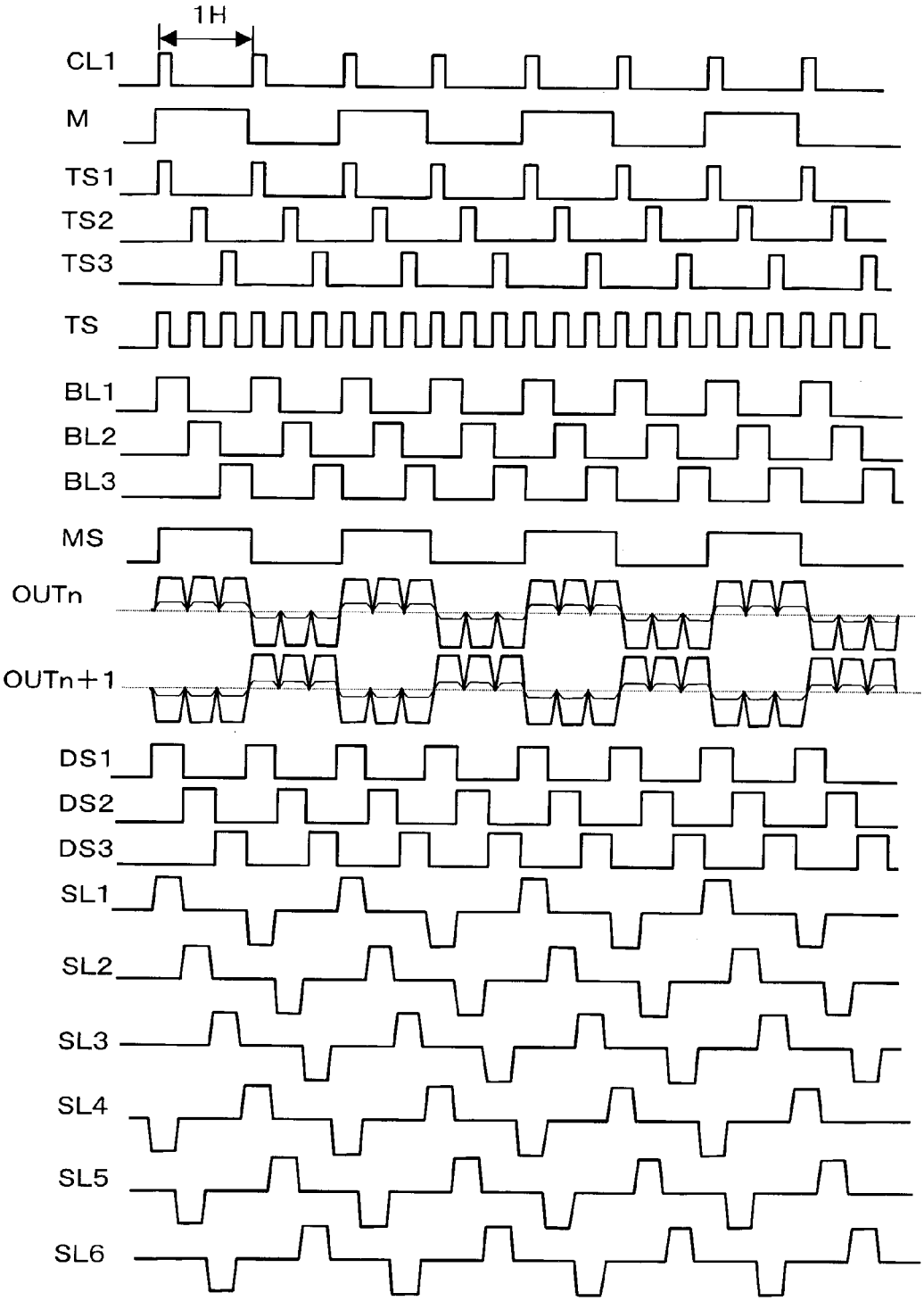
FIG. 19 is a schematic timing chart showing a driving method of the liquid crystal display device according to one embodiment of the present invention.

Referring to FIG. 18, in, the time-division signal generating circuit 26, a time-division control signal TS shown in FIG. 19 is formed based on the time-division control signals TS1 to TS3 and the time-division control signal TS is transmitted to a changeover signal control circuit 40 through a time-division signal line 41. In the changeover signal control circuit 40, a changeover signal MS is formed based on the time-division control signal TS and the AC signal M and the changeover signal MS is outputted to the changeover signal line 38. Further, as mentioned previously, the changeover signal control circuit 40 is capable of outputting the changeover signal MS such that the analogue switches 37-1 to 37-4 are simultaneously turned off.

Subsequently, FIG. 19 shows a timing chart in which the gray scale voltage having the same polarity is outputted from one output terminal 30 during 1 horizontal scanning period 1H in the circuits shown in FIG. 16 to FIG. 18. In the timing chart, M indicates an AC signal and is a signal which is inputted to the second source driver 6 from the outside. This AC signal indicates timing of polarity changeover. As mentioned previously, TS is the time-division control signal and BL indicates the time-division signal. MS is a changeover signal which is transmitted to the changeover switch 36 through the changeover signal line 38. The changeover signal MS is formed based on the AC signal M and the time-division control signals TS1 to TS3. In FIG. 19, the changeover signal MS is in synchronism with the AC signal M. However, the rising of the changeover signal MS is not limited to the case in which the changeover signal MS rises simultaneously with the rising of the AC signal M and the waveform of the changeover signal MS is adjusted based on driving conditions. OUTn and OUTn+1 indicate outputs of two neighboring output terminals 30. Here, it is assumed that, in FIG. 17 and FIG. 18, the changeover signal line 38-1 is HIGH when the changeover signal MS is HIGH and the changeover signal line 38-2 is LOW when the changeover signal line 38-1 is HIGH.

During a period in which the changeover signal MS is high, the gray scale voltage of positive polarity is outputted from the OUTn and the gray scale voltages of negative polarity is outputted from the OUTn+1. Further, during a period in which the changeover signal MS is LOW, the gray scale voltage of negative polarity are outputted from the OUTn and the gray scale voltages of positive polarity is outputted from the OUTn+1. As mentioned previously, the output terminals 30 are connected to three video signal lines 8 using the distributing transistors 62 of the first source driver 60. DS1 to DS3 are distributing signals which control the distributing transistors 62, SL1 to SL3 indicate gray scale voltages which are supplied to three video signal lines 8 connected to the output terminal 30-1, and SL4 to SL6 indicate gray scale voltages which are supplied to three video signal lines 8 connected to the output terminal 30-2.

To focus an attention to 1 horizontal scanning period 1H, the gray scale voltages having the same polarity are supplied to the signals SL1 to SL3, and the gray scale voltages are supplied to the video signal lines 8 during respective periods formed by dividing 1 horizontal scanning period 1H in three periods. Further, the signals SL4 to SL6 assume the polarity opposite to the polarity of the signals SL1 to SL3. Accordingly, the gray scale voltages of the same polarity are supplied to three continuous video signal lines 8, while the gray scale voltages which invert polarities for every three video signal lines are supplied to the video signal lines. Although described previously, here, the polarity means either the positive polarity or the negative polarity with respect to the common voltage of the counter electrode.

Figure 20:
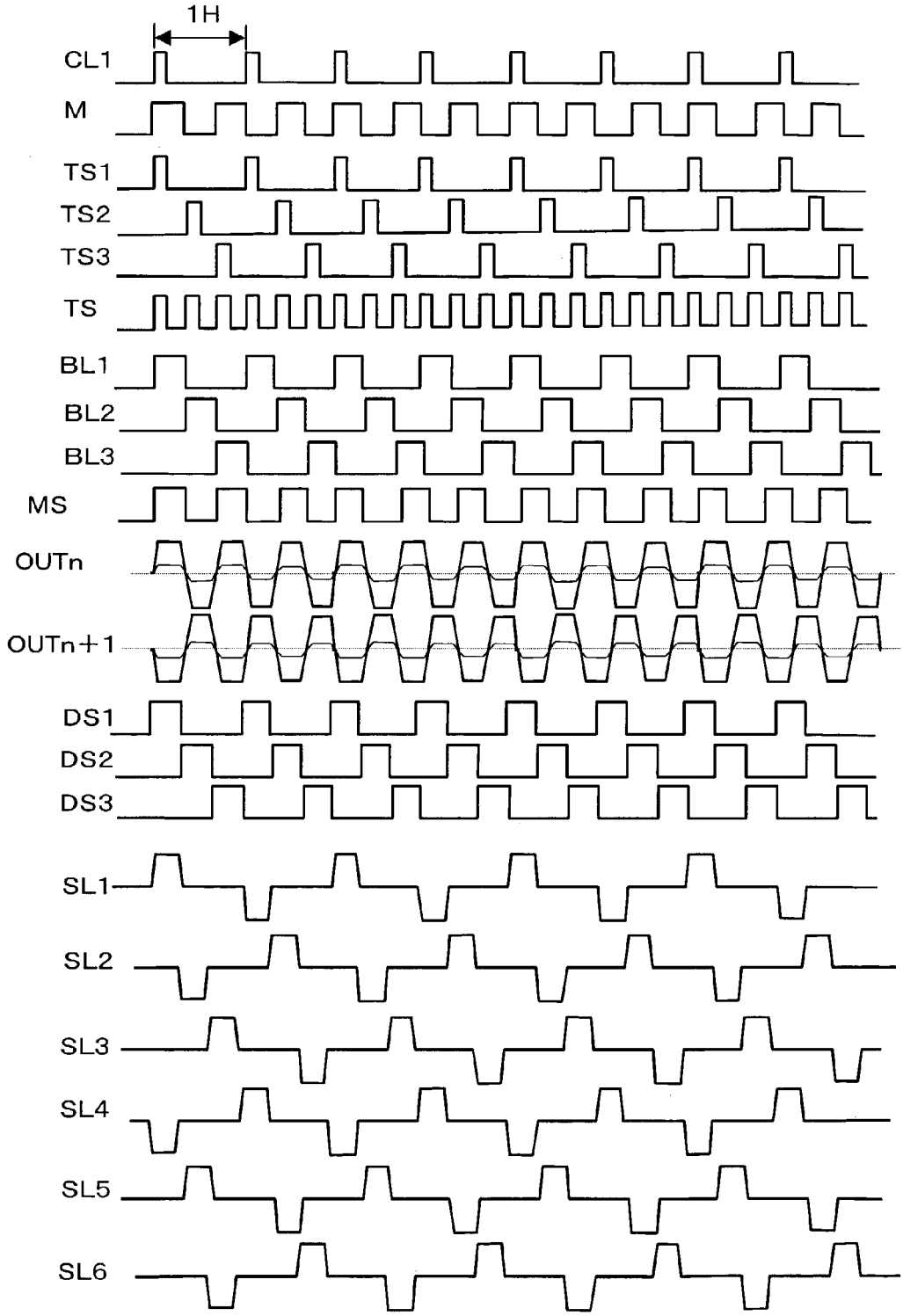
FIG. 20 is a schematic timing chart showing a driving method of the liquid crystal display device according to one embodiment of the present invention.

Then, FIG. 20 shows a timing chart in which, in the circuits shown in FIG. 16 to FIG. 18, the gray scale voltages having positive polarity, negative polarity and positive polarity are time-sequentially outputted from one output terminal 30 during 1 horizontal scanning period 1H. Although the changeover signal MS is formed based on the AC signal M and the time-division control signal TS, a signal which divides 1 horizontal scanning period 1H into three periods is outputted at timing equal to the timing for outputting the time-division signal BL.

That is, although the AC signal M is supplied from the controller 3 shown in FIG. 1, in the changeover signal control circuit 40, to make the timing of the AC signal M match the timing of the time-division signal BL, the changeover signal MS is formed based on the AC signal M and the time-division control signal TS. Further, as the time-division control signal TS used in the changeover signal control circuit 40, it is possible to use the time-division control signals TS1 to TS3 which are supplied from the controller 3 through the time-division control signal lines 16. Further, it is possible to generate the time-division control signal TS in the time-division signal generating circuit 26 in response to the time-division control signals TS1 to TS3 as shown in FIG. 18 and then to supply the time-division control signal TS to the changeover signal control circuit 40 through the time-division signal lines 41.

Then, a case in which the gray scale voltages of positive polarity, negative polarity and positive polarity, for example, are outputted time-sequentially from the output terminal 30-1 shown in FIG. 17 is explained. First of all, during a period in which the time-division signal BL1 is HIGH, the switching circuit 32-1 is turned on in response to the time-division signal line 19-1. Here, since the changeover signal MS is HIGH, the changeover switch 36-2 connects the output of the data line selector circuit 25-1 to the level shifter circuit 27-1. Accordingly, the data of the display data line 31-1 are inputted to the level shifter circuit 27-1. The data which are inputted to the level shifter circuit 27-1 are converted into the gray scale voltage by a decoder circuit 28-1 and is outputted from a high voltage output amplifier 29-1 as the gray scale voltage of positive polarity. Since the changeover signal MS is HIGH, the changeover switch 36-1 connects the output of the high voltage output amplifier 29-1 to the output terminal 30-1 and hence, the gray scale voltage of positive polarity is outputted from the output terminal 30-1. Here, from the output terminal 30-2, the gray scale voltage of negative polarity having a voltage value which corresponds to data outputted from the data line selector circuit 25-2 is outputted.

Then, during a period in which the time-division signal BL2 is HIGH, the switching circuit 32-2 assumes the ON state. Here, since the changeover signal MS is LOW, the changeover switch 36-2 connects the output of the data line selector circuit 25-1 to the level shifter circuit 27-2. Accordingly, the data of the display data line 31-2 are inputted to a level shifter circuit 27-2. The data of the display data line 31-2 are converted into a gray scale voltage by a decoder circuit 28-2 and the gray scale voltage of negative polarity is outputted from a low voltage output amplifier 29-2. Since the changeover signal MS is LOW, the changeover switch 36-1 connects the low voltage output amplifier 29-2 to the output terminal 30-1 and the gray scale voltage of negative polarity is outputted.

Thereafter, during a period in which the time-division signal BL3 is HIGH, the switching circuit 32-3 assumes the ON state. The data of the display data line 31-3 are inputted to the level shifter circuit 27-1, the output of the high voltage output amplifier 29-1 is connected to the output terminal 30-1, and the gray scale voltage of positive polarity is outputted from the output terminal 30-1. Here, from the output terminal 30-2, as indicated by the signal OUTn+1, the gray scale voltages of negative polarity, positive polarity and negative polarity are time-sequentially outputted.

Accordingly, among the signals SL1 to SL3 which are supplied to the video signal lines 8, the signal SL2 assumes the polarity opposite to the polarity of the signal SL1 and the signal SL3 assumes the polarity opposite to the polarity of the signal SL2. That is, to every video signal line 8, the signal which has the polarity opposite to the polarity of the signal supplied to the neighboring video signal line is supplied.

Figure 21:
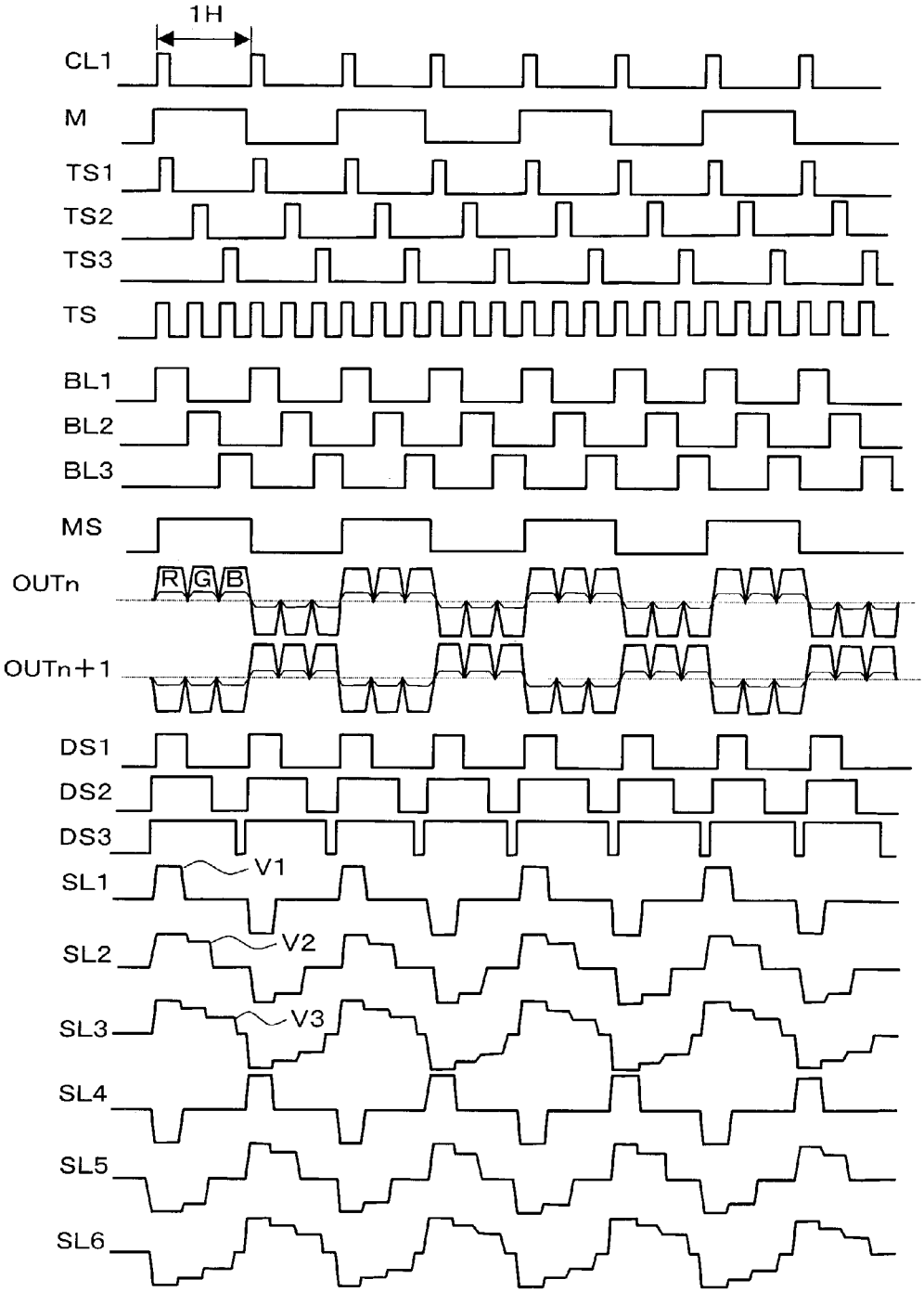
FIG. 21 is a schematic timing chart showing a driving method of the liquid crystal display device according to one embodiment of the present invention.

Then, a method for pre-charging the video signal lines other than the video signal line to which the gray scale voltage is going to be applied by turning on all three distributing transistors 62 simultaneously with starting of the horizontal scanning period 1H is explained in conjunction with FIG. 21. First of all, the distributing control signals DS1 to DS3 are set to a HIGH state simultaneously with starting of the horizontal scanning period 1H. Accordingly, all of the distributing transistors 62 which are controlled by the distributing control signal lines 63 shown in FIG. 7, for example, are turned on so that the gray scale voltages are outputted to the video signal lines 8.

As mentioned previously, although the OUTn indicates the signal which the second source driver 6 outputs, the value of the signal OUTn is time-sequentially changed in the order of a signal R, a signal G, a signal B during 1 horizontal scanning period 1H. During a period in which the distributing control signals DS1 to DS3 are HIGH and the signal OUTn assumes a gray scale voltage indicated by the signal R, the signals SL1 to SL3 which are supplied to the video signal lines assume a gray scale voltage V1 indicated by the signal R. Here, although the signal R is an arbitrary voltage corresponding to the gray scale of the pixel, to simplify and clarify the explanation, the signal R is expressed as V1 in FIG. 21, the signal G is expressed by V2, and the signal B is expressed by V3.

Although the signal R is a signal which is to be supplied to the first video signal line 8 (R) shown in FIG. 7, the signal R is also supplied to the video signal lines 8 (G), 8(B) so that the video signal lines 8 (G), 8(B) are precharged. In performing the alternating current driving, the voltage on the video signal line 8 has the polarity opposite to a voltage to be written and hence, it is effective to supply the voltage having the polarity equal to the polarity of the gray scale voltage to be written in the video signal line 8 preliminarily as in a case that the driving frequency is increased so that the distributing transistor 62 cannot follow.

Thereafter, during the period in which the signal R is supplied, the distributing control signal DS1 assumes a LOW state and the gray scale voltage V1 indicated at the signal SL1 is held in the first video signal line 8 (R). During the period in which the signal G is outputted following the signal R, the distributing control signals DS2 and DS3 assume a HIGH state and the signals SL2 and SL3 assume V2 which is a voltage value of the signal G. Accordingly, the voltage V2 is supplied to the video signal lines 8(G) and 8(B).

Thereafter, during the period in which the signal G is supplied, the distributing control signal DS2 assumes a LOW state and the gray scale voltage V2 indicated at the signal SL2 is held in the second video signal line 8 (G). During the period in which the signal B is outputted following the signal G, the distributing control signal DS3 assumes a HIGH state and the signal SL3 assumes V3 which is a voltage value of the signal B. Accordingly, the voltage V3 is supplied to the video signal line 8(B).

Although the method which precharges two video signal lines out of three video signal lines has been explained heretofore, a method which precharges one video signal line out of three video signal lines can be also practically used. Although the explanation is made as a whole with respect to the case in which the number of the video signal lines which can be distributed from the first source driver is set to three, the present invention can be carried out using the similar constitution even when the number of such video signal lines is any number other than 3.

To briefly recapitulate the advantageous effects obtained by the typical inventions out of inventions disclosed by the present application, they are as follows.

(1) According to the present invention, it is possible to realize the liquid crystal display device which includes driving circuits of a proper circuit scale.

(2) According to the present invention, it is possible to realize the liquid crystal display device which is driven by an externally-mounted driving circuit which can reduce the number of output terminals with respect to the number of video signal lines which can be driven.

What is claimed is:

1. A liquid crystal display device comprising:

a liquid crystal display panel having a plurality of pixels, each of the pixels including a pixel electrode, a pixel transistor and a counter electrode; and a plurality of driving circuits which drive the liquid crystal display panel, the driving circuits including a plurality of first driving circuits which are connected by a wiring made of a same layer as a wiring of the pixel and a second driving circuit which is mounted on a flexible board and connected to the liquid crystal display panel after formation of the liquid crystal display panel, wherein the second driving circuit supplies a video signal from one output terminal thereof to a video signal line of the liquid crystal display panel, and the flexible board has an output terminal portion, an input terminal portion, a first control signal line transmitting a control signal to at least one of the first driving circuits, a second control signal line transmitting the control signal via the input terminal portion to the second driving circuit, an output signal line transmitting the video signal from the second driving circuit via the output terminal portion, and a counter electrode signal line supplying a voltage to said counter electrode of the liquid crystal display panel, and wherein the counter electrode signal line is disposed along the output signal line within the output terminal portion and along the second control signal line within the input terminal portion.

2. A liquid crystal display device according to claim 1, wherein the counter electrode signal line electrically connect to a wiring formed between two adjacent one of the first driving circuits.

3. A liquid crystal display device according to claim 1, wherein the second control signal line is disposed between two counter electrode signal lines.

* * * * *